US009821576B2

(12) United States Patent
Sano

(10) Patent No.: US 9,821,576 B2
(45) Date of Patent: Nov. 21, 2017

(54) TAPE PRINTER AND RECORDING MEDIUM

(71) Applicant: Brother Kogyo Kabushiki Kaisha, Nagoya-shi, Aichi-ken (JP)

(72) Inventor: Nako Sano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/423,005

(22) Filed: Feb. 2, 2017

(65) Prior Publication Data

US 2017/0239962 A1 Aug. 24, 2017

(30) Foreign Application Priority Data

Feb. 24, 2016 (JP) ..... 2016-032770

(51) Int. Cl.
*B41J 13/00* (2006.01)
*B41J 3/407* (2006.01)

(52) U.S. Cl.
CPC ..... *B41J 13/0009* (2013.01); *B41J 3/4075* (2013.01)

(58) Field of Classification Search
CPC ..... B41J 13/0009; B41J 3/4075; B41J 13/00; B41J 15/046; B41J 15/044; B41J 15/04; B41J 15/00
See application file for complete search history.

(56) References Cited

U.S. PATENT DOCUMENTS 6,373,510 B1 * 4/2002 Hosokawa ..... B41J 3/4075 347/171
6,452,694 B1 9/2002 Eisenberg et al.
2004/0208682 A1 10/2004 Akaiwa et al.
2005/0226670 A1 10/2005 Akaiwa et al.
2015/0022614 A1 * 1/2015 Guan ..... B41J 3/4075 347/172
2015/0273865 A1 * 10/2015 Kubota ..... B41J 3/4075 347/110

FOREIGN PATENT DOCUMENTS

JP 2001-347702 A 12/2001
JP 2002-522996 A 7/2002
JP 2004-216833 A 8/2004

* cited by examiner

*Primary Examiner* — Kristal Feggins
(74) *Attorney, Agent, or Firm* — Banner & Witcoff, Ltd.

(57) ABSTRACT

The disclosure discloses a tape printer including a print data generating portion, and a coordination control portion. The print data generating portion is configured to generate print data in which two processed letter strings generated by applying predetermined decorative tape process to the one or two letter strings accepted by a letter string accepting portion are arranged at one end portion and another end portion of a decorative print-receiving tape in a tape length direction, the decorative print-receiving tape having a full length set by a full-length setting portion. The coordination control portion is configured to control a feeder and a printing head in coordination with each other using the print data generated by the print data generating portion, to produce the decorative tape with print having the full length.

10 Claims, 24 Drawing Sheets

[FIG. 1]
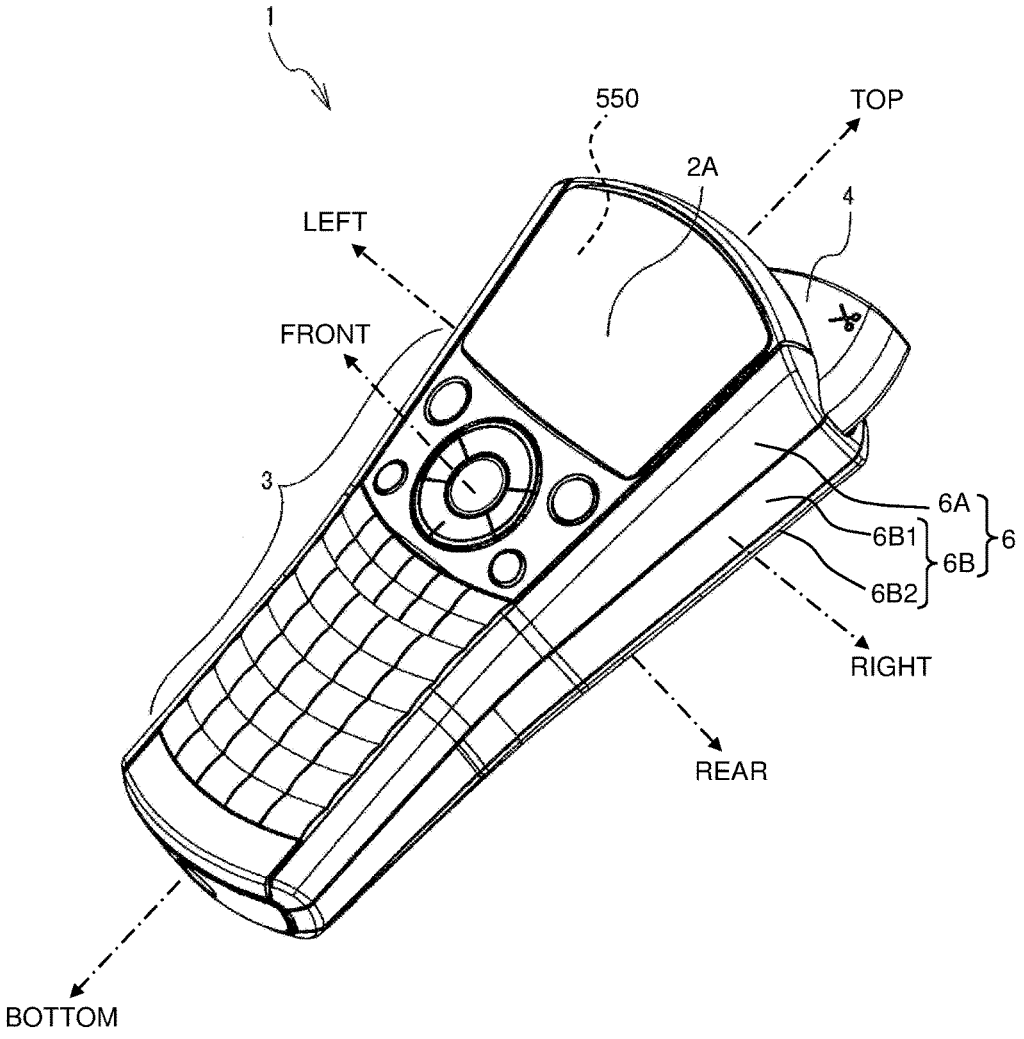

[FIG. 2]
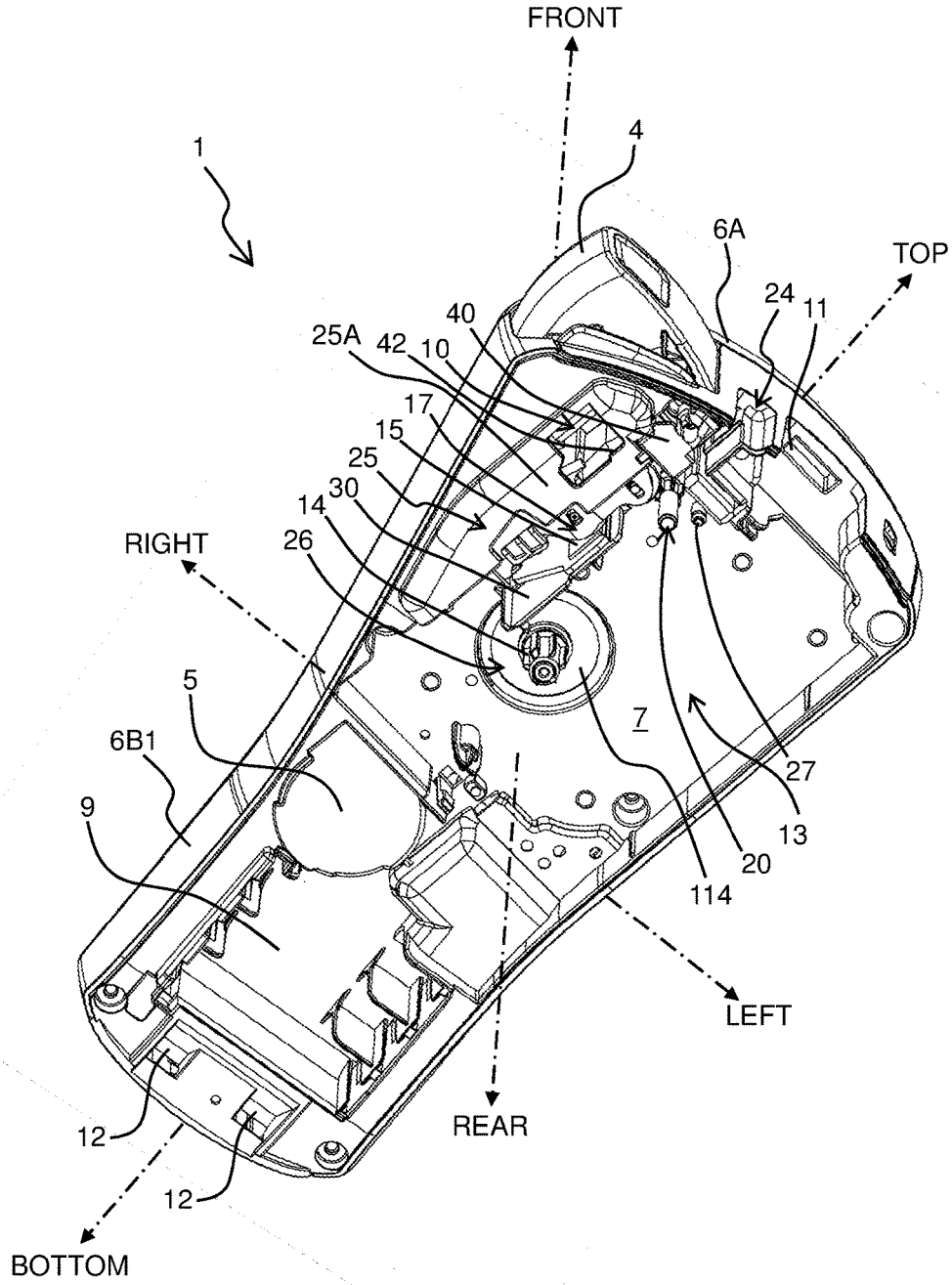

[FIG. 3]
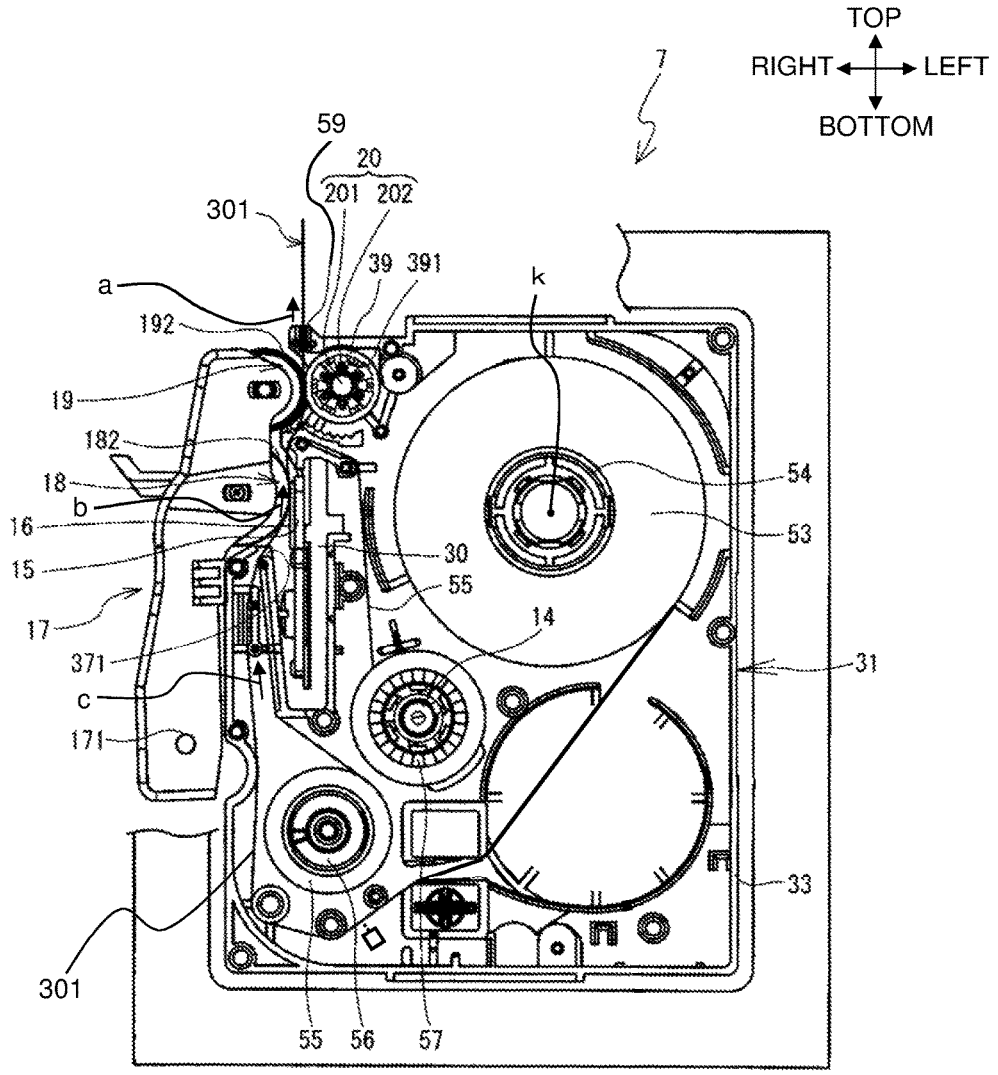

[FIG. 4]
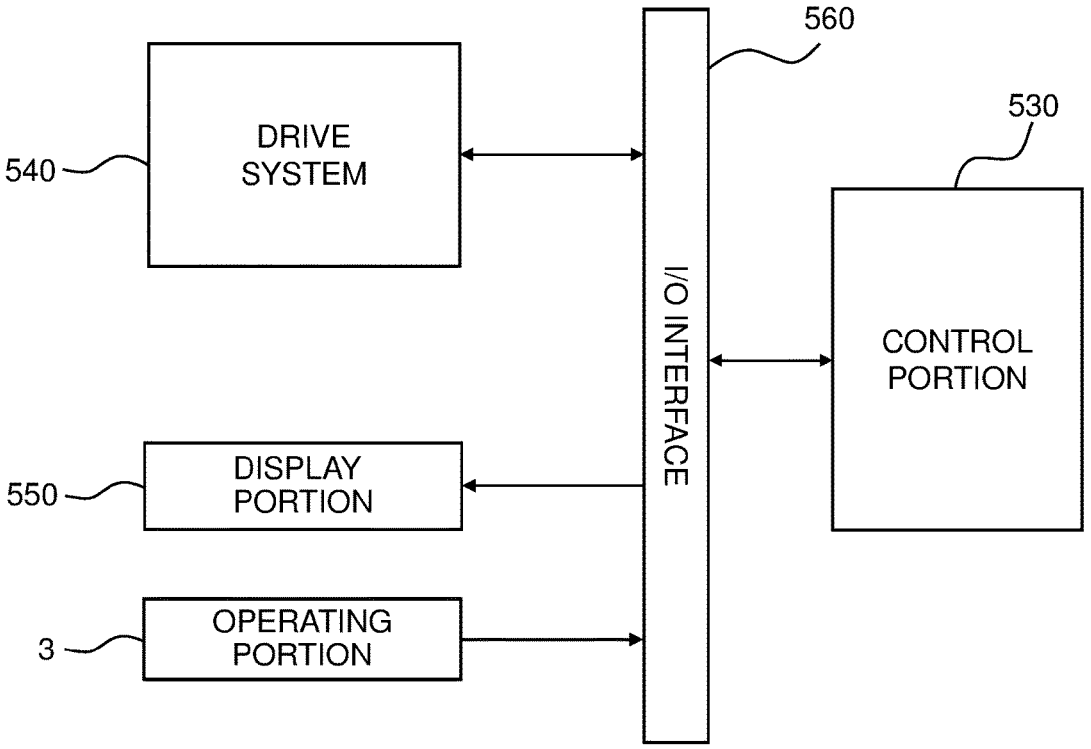

[FIG. 5]
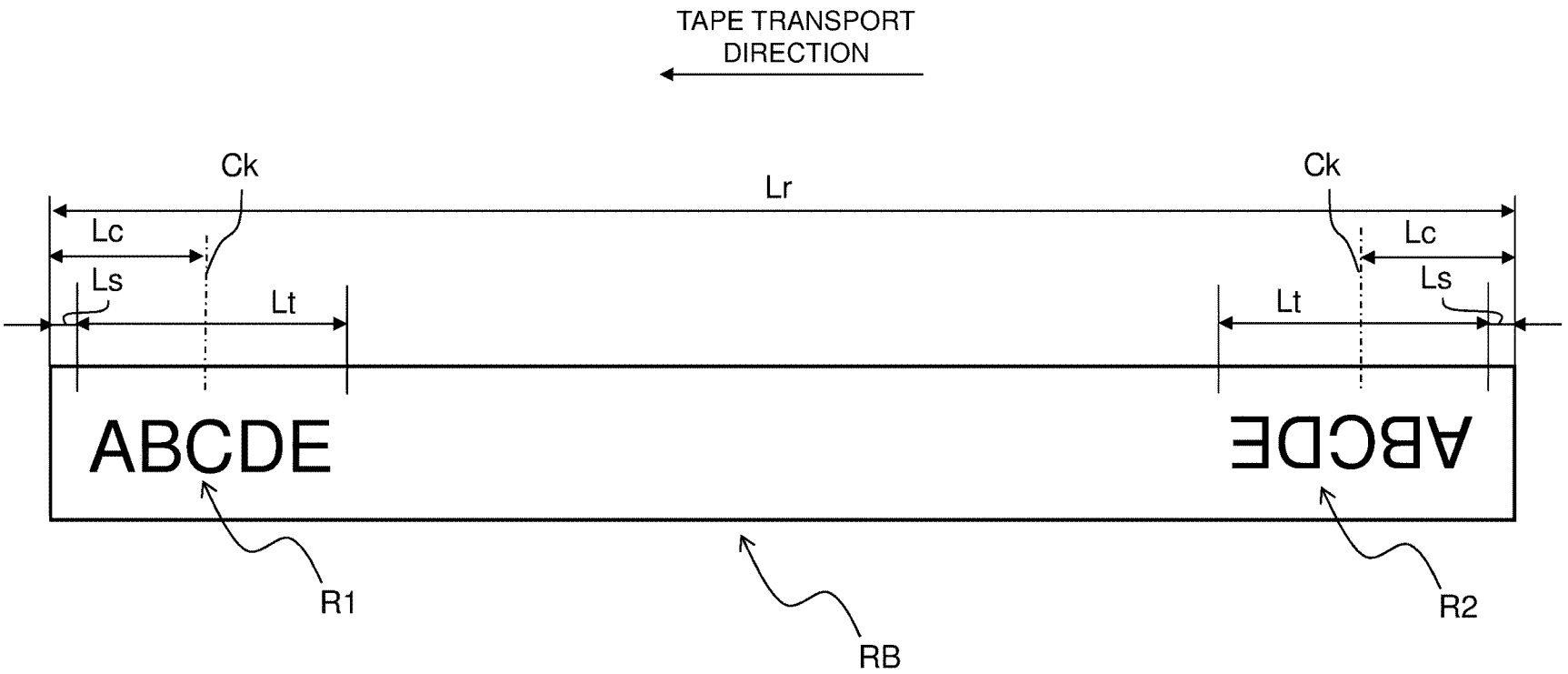

[FIG. 6]
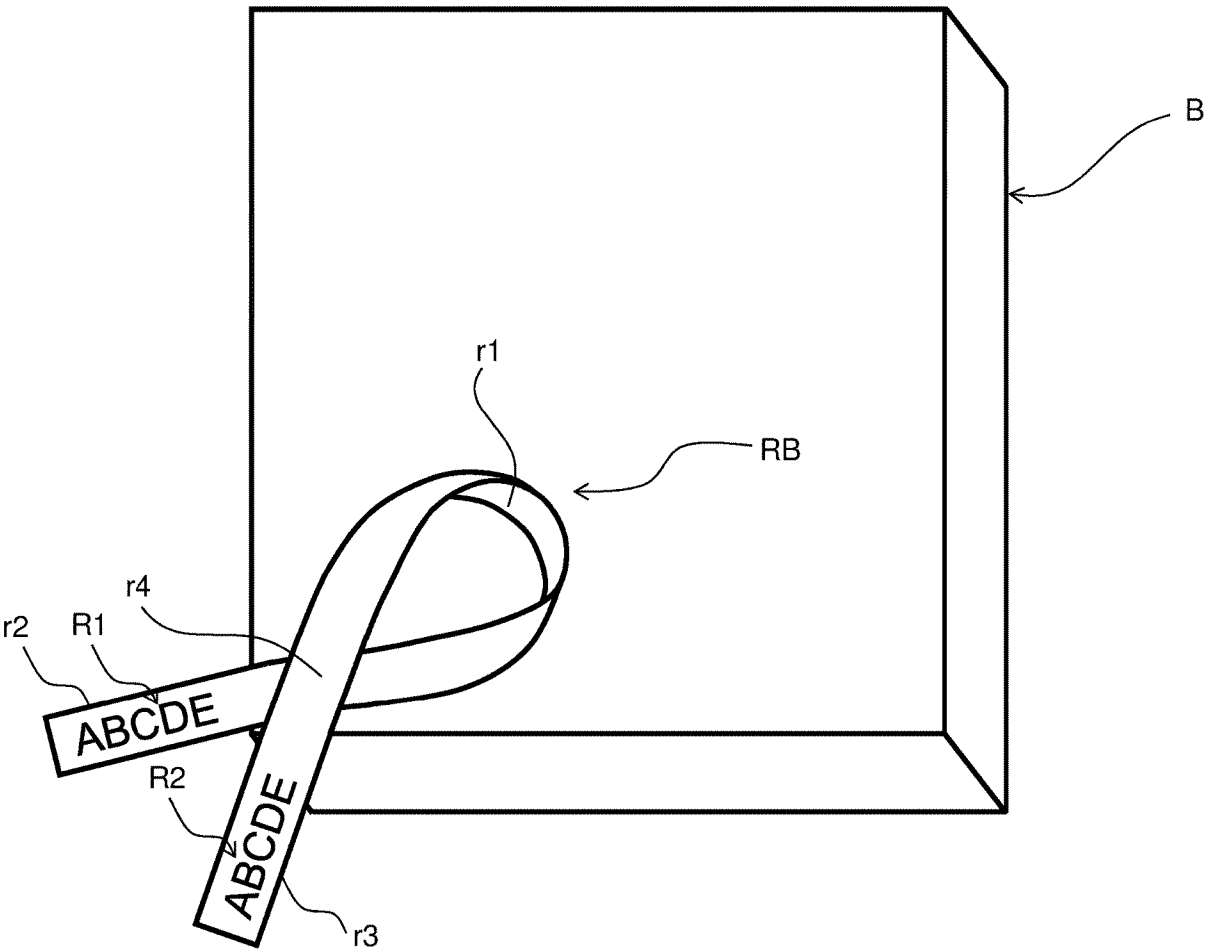

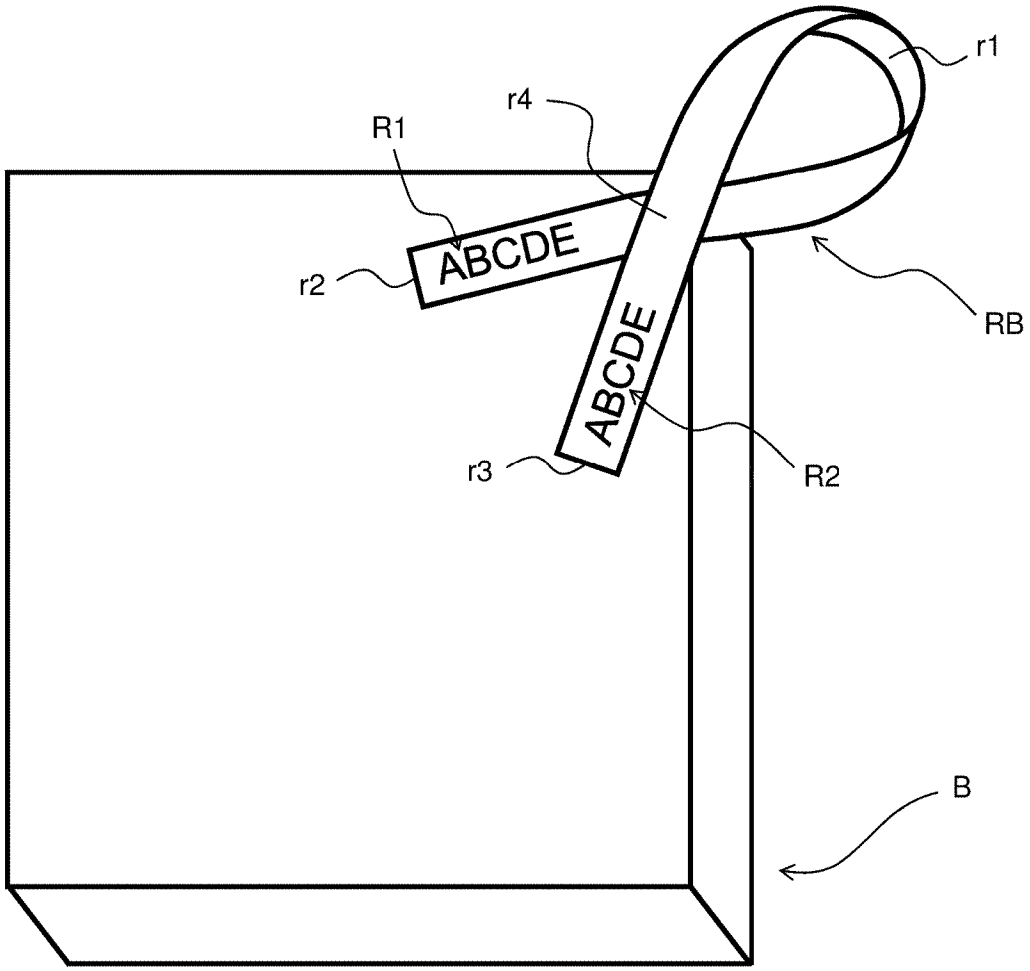
[FIG. 7]

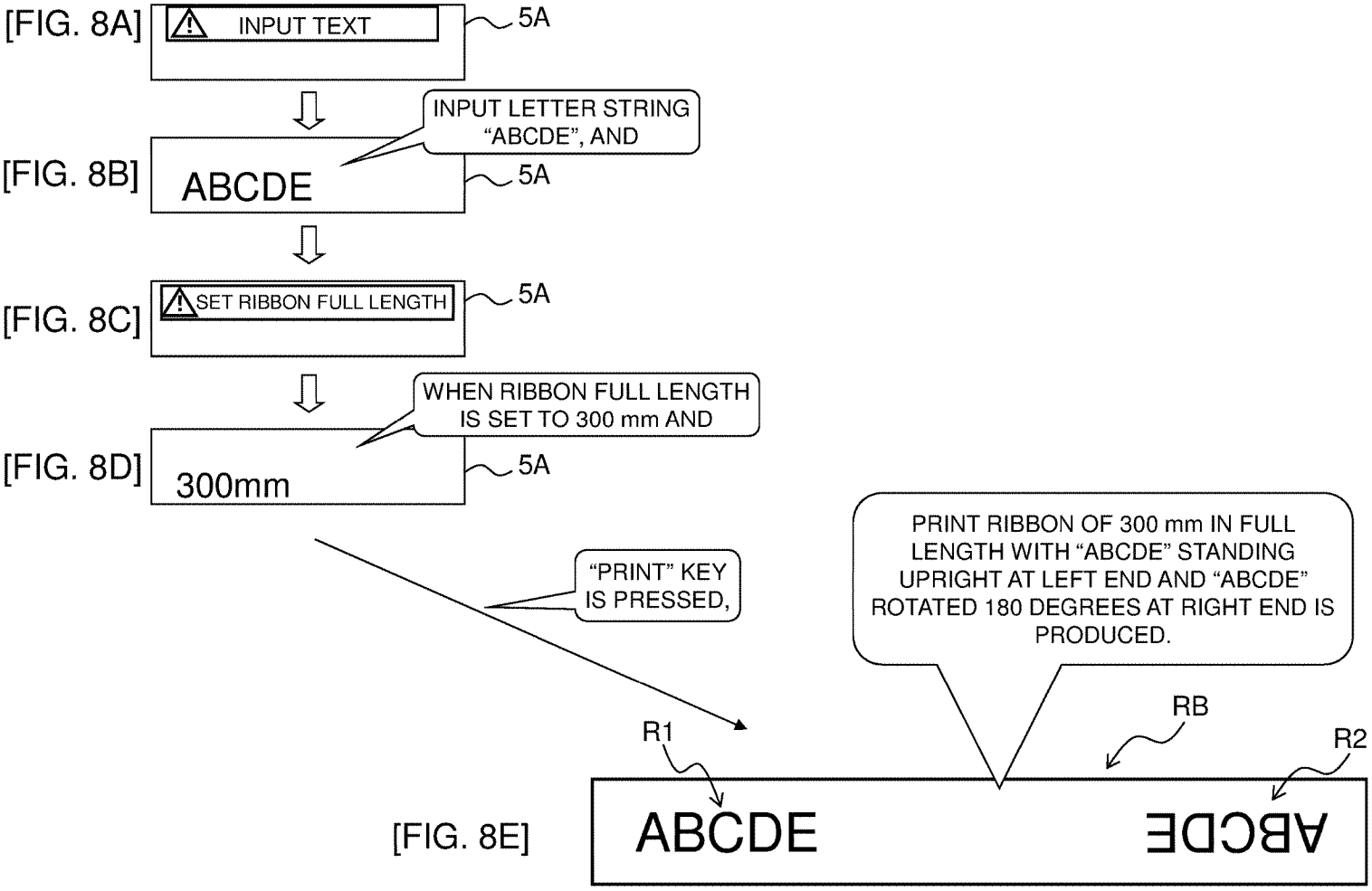
5A
INPUT TEXT
[FIG. 8A]
INPUT LETTER STRING "ABCDE", AND
5A
ABCDE
[FIG. 8B]
5A
SET RIBBON FULL LENGTH
[FIG. 8C]
WHEN RIBBON FULL LENGTH IS SET TO 300 mm AND
5A
300mm
[FIG. 8D]
"PRINT" KEY IS PRESSED,
PRINT RIBBON OF 300 mm IN FULL LENGTH WITH "ABCDE" STANDING UPRIGHT AT LEFT END AND "ABCDE" ROTATED 180 DEGREES AT RIGHT END IS PRODUCED.
R1
R2
RB
ABCDE
ABCDE
[FIG. 8E]

[FIG. 9]
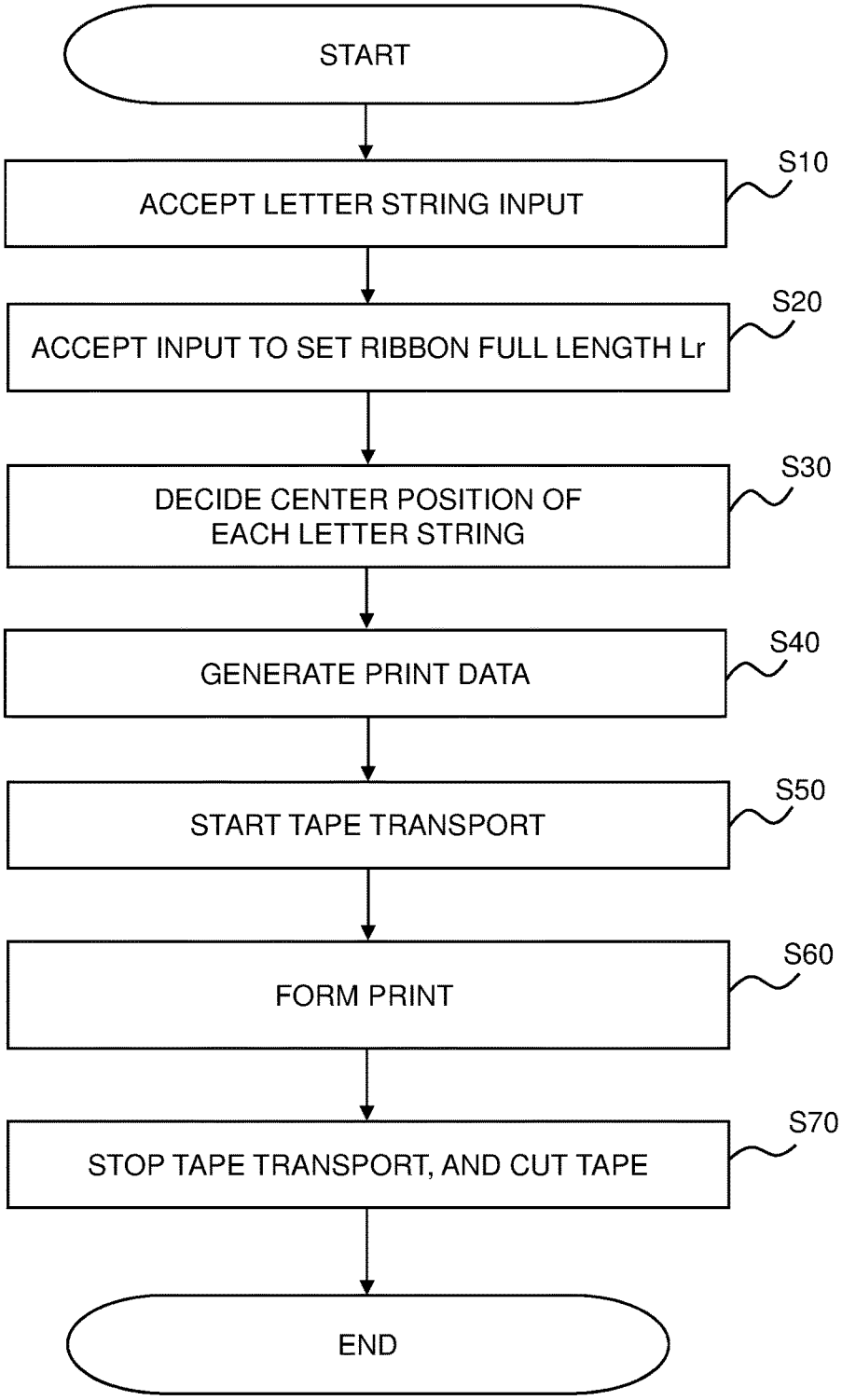

[FIG. 10]
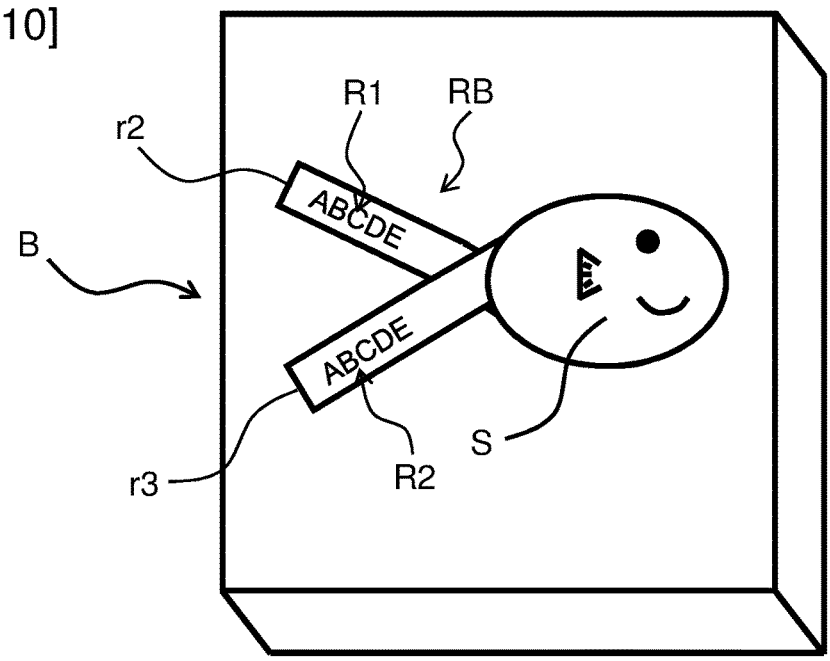
[FIG. 11]
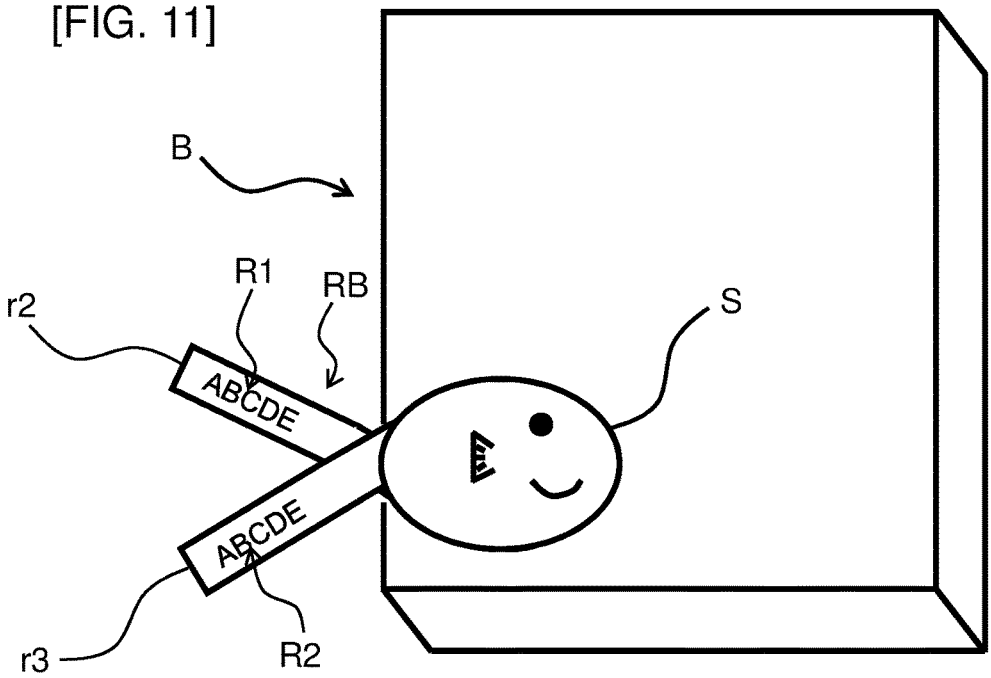

[FIG. 12A]
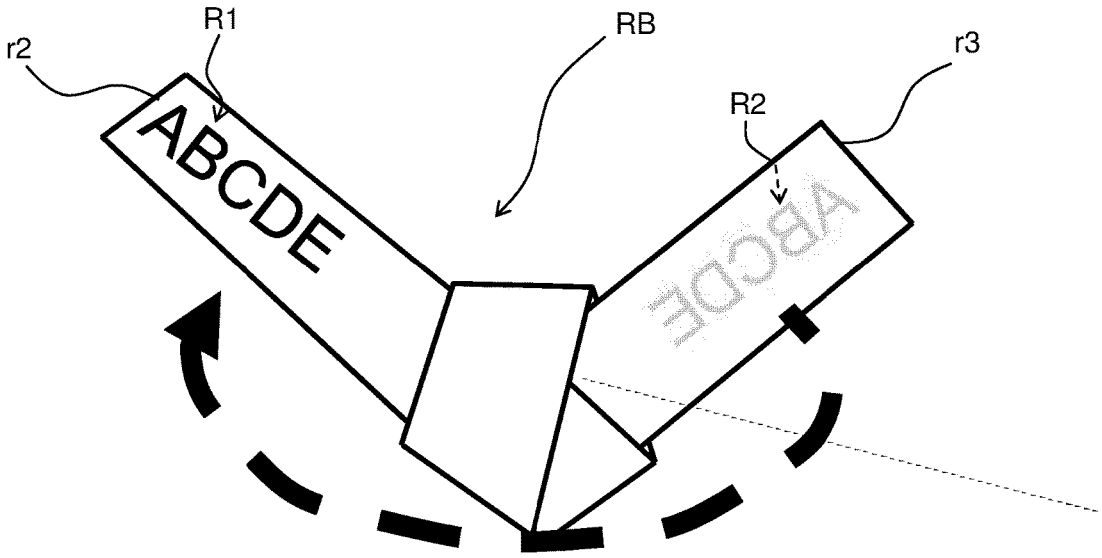
[FIG. 12B]
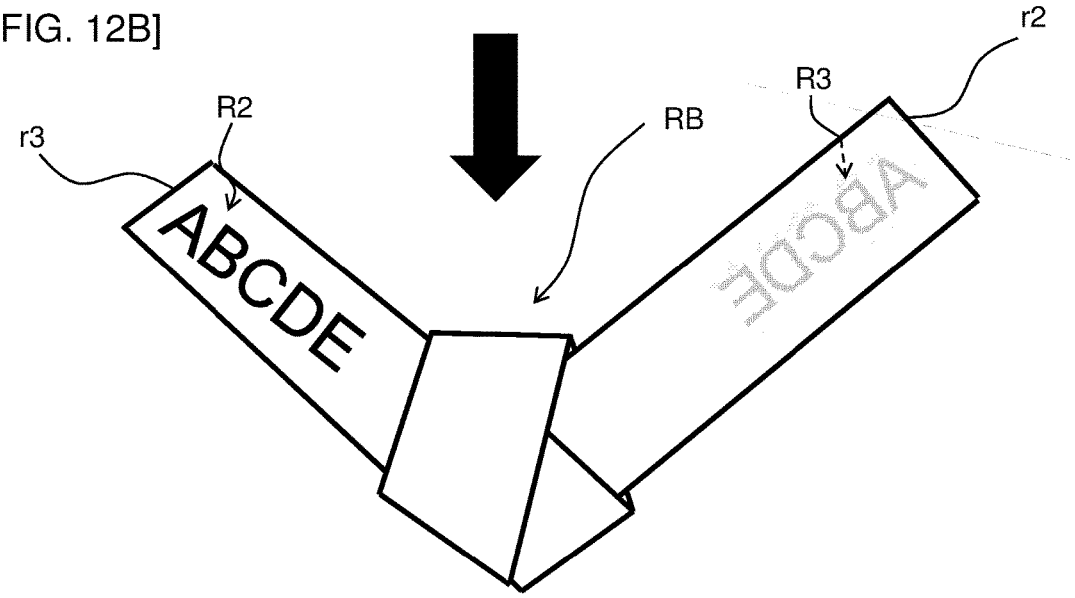

[FIG. 13A]
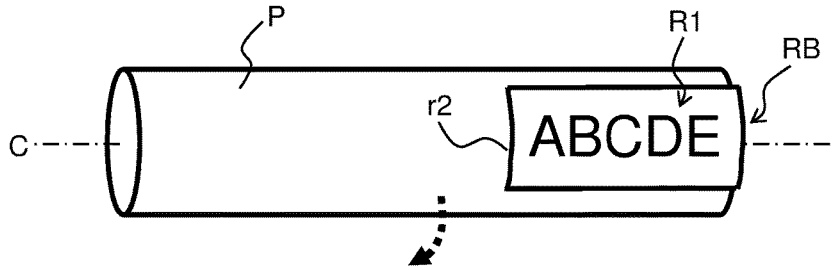
[FIG. 13B]
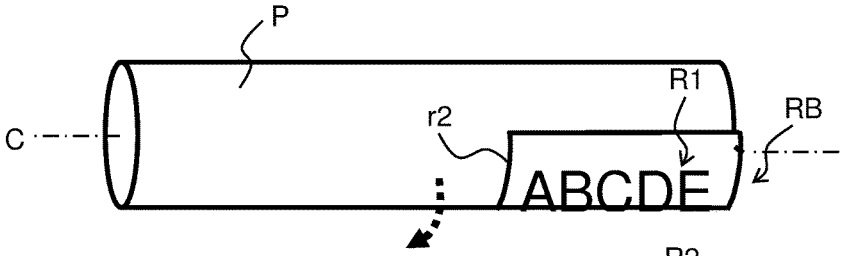
[FIG. 13C]
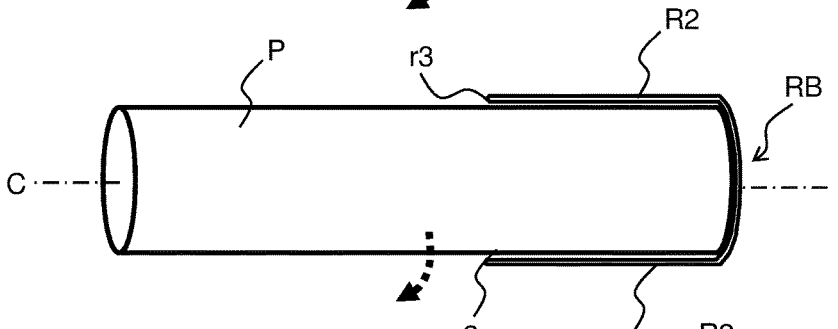
[FIG. 13D]
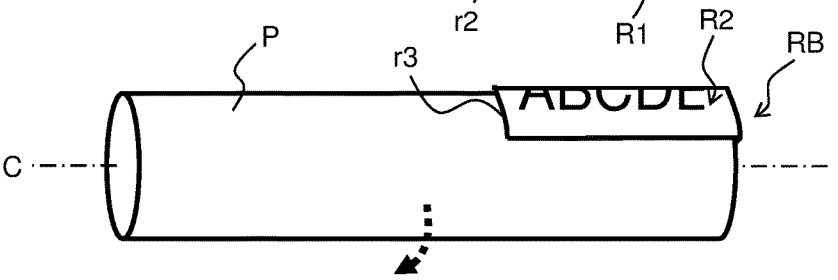
[FIG. 13E]
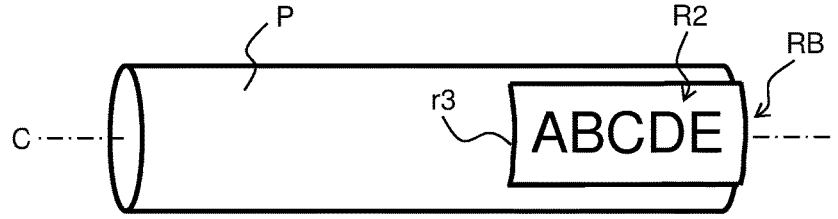

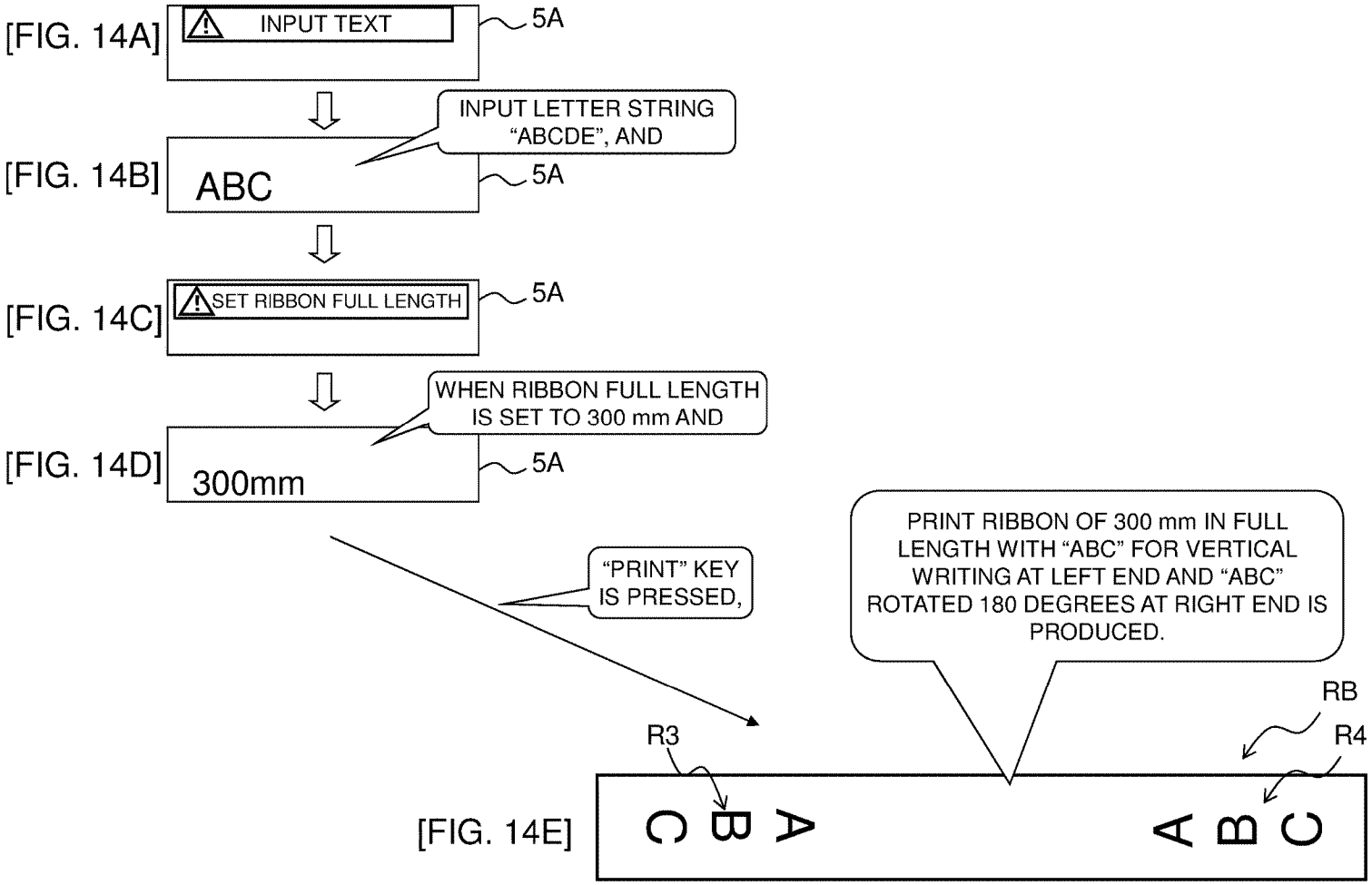
5A
INPUT TEXT
[FIG. 14A]
INPUT LETTER STRING "ABCDE", AND
5A
ABC
[FIG. 14B]
5A
SET RIBBON FULL LENGTH
[FIG. 14C]
WHEN RIBBON FULL LENGTH IS SET TO 300 mm AND
5A
300mm
[FIG. 14D]
"PRINT" KEY IS PRESSED,
PRINT RIBBON OF 300 mm IN FULL LENGTH WITH "ABC" FOR VERTICAL WRITING AT LEFT END AND "ABC" ROTATED 180 DEGREES AT RIGHT END IS PRODUCED.
RB
R4
R3
A
B
C
A
B
C
[FIG. 14E]

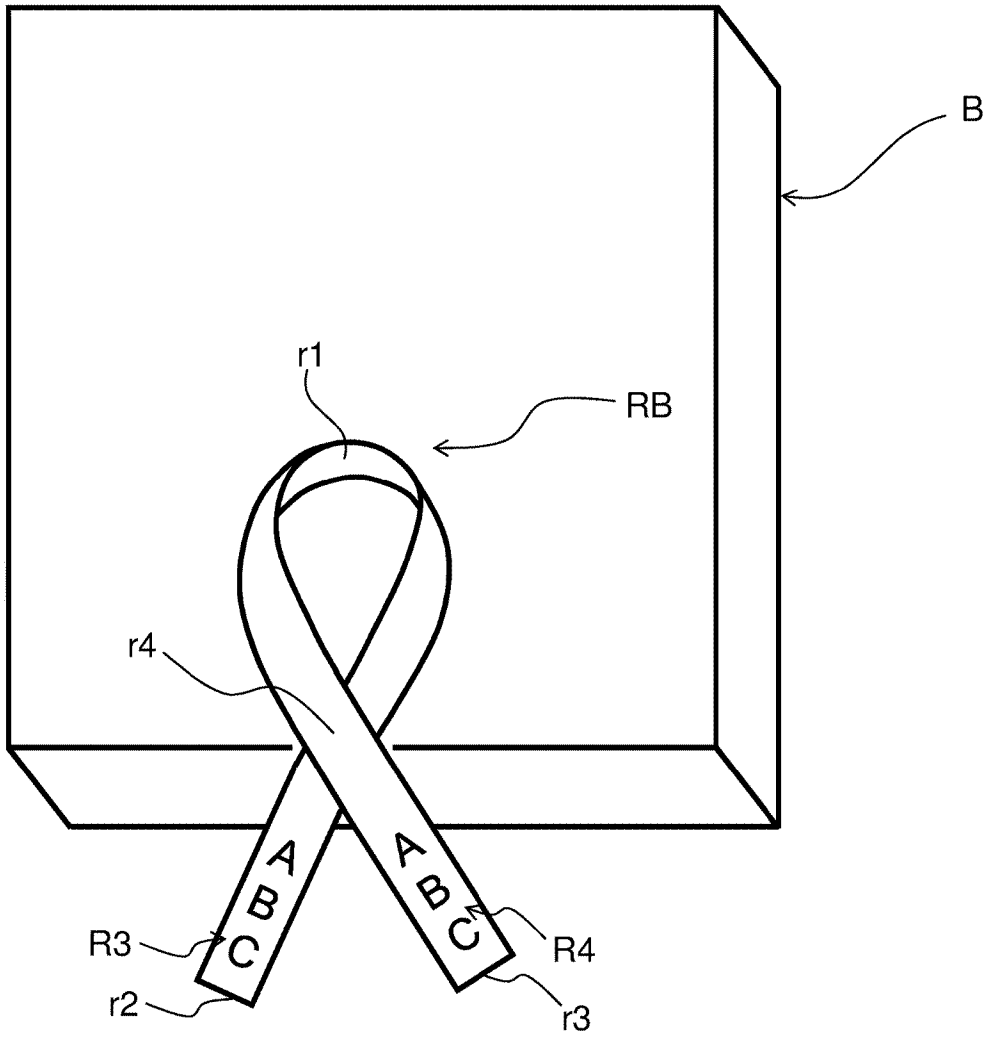
[FIG. 15]

[FIG. 16]
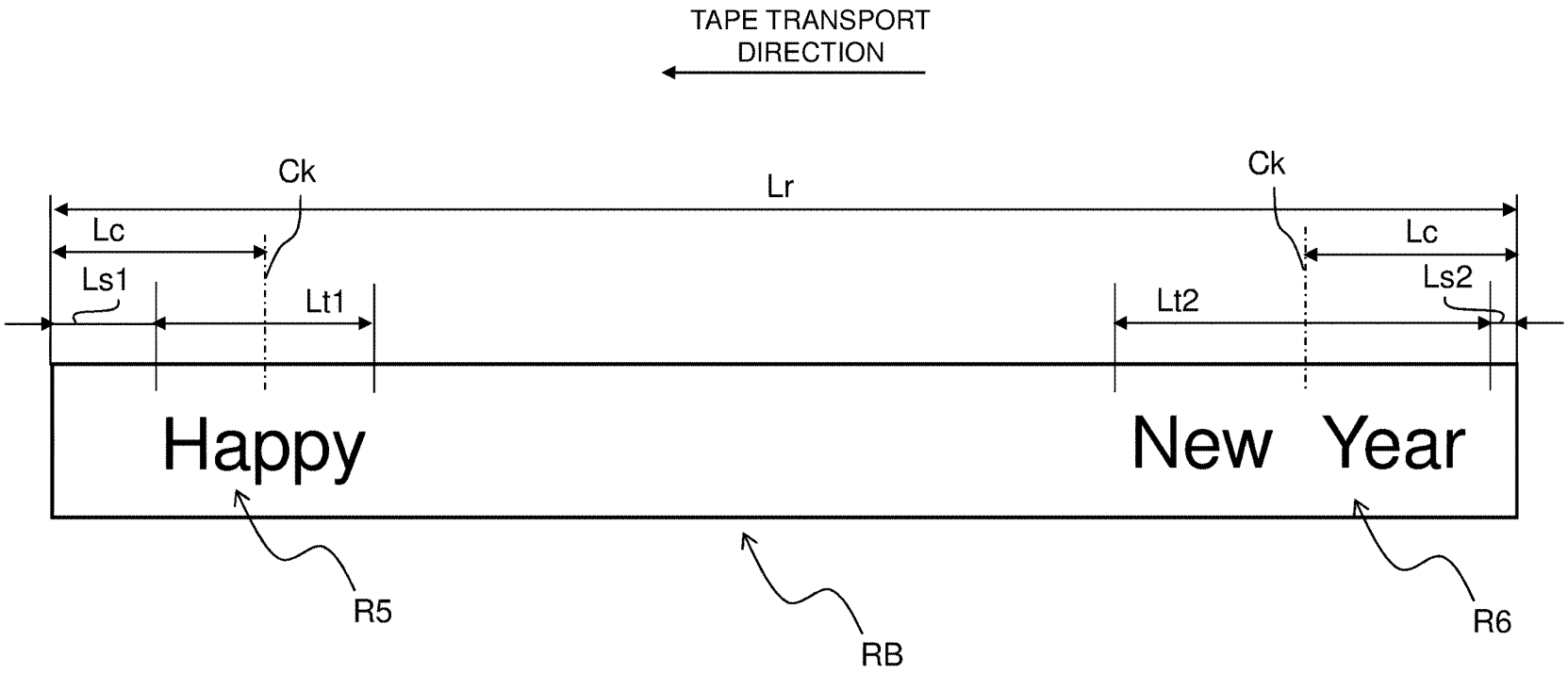

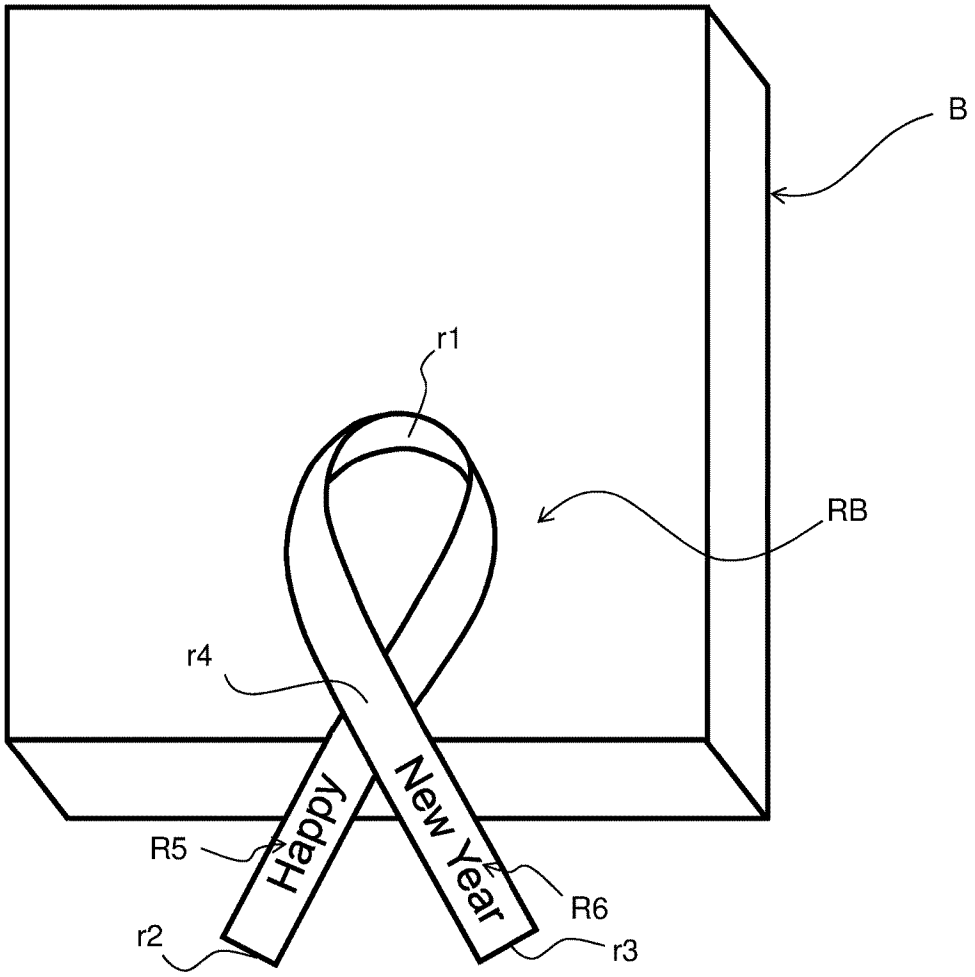
[FIG. 17]

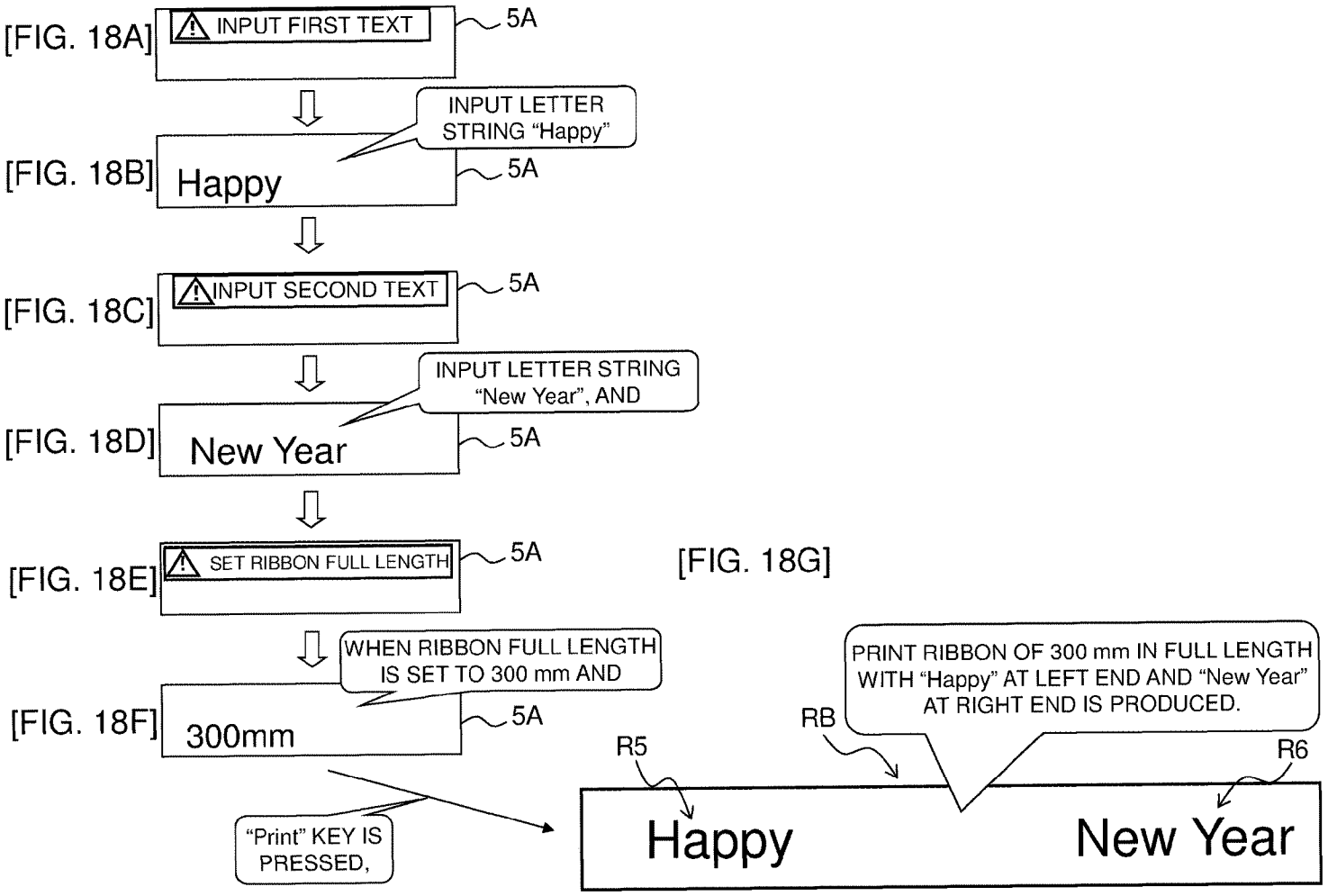
[FIG. 18A]
INPUT FIRST TEXT
5A
[FIG. 18B]
INPUT LETTER STRING "Happy"
Happy
5A
[FIG. 18C]
INPUT SECOND TEXT
5A
[FIG. 18D]
INPUT LETTER STRING "New Year", AND
New Year
5A
[FIG. 18E]
SET RIBBON FULL LENGTH
5A
[FIG. 18F]
WHEN RIBBON FULL LENGTH IS SET TO 300 mm AND
300mm
5A
"Print" KEY IS PRESSED,
[FIG. 18G]
PRINT RIBBON OF 300 mm IN FULL LENGTH WITH "Happy" AT LEFT END AND "New Year" AT RIGHT END IS PRODUCED.
RB
R5
R6
Happy
New Year

[FIG. 19]
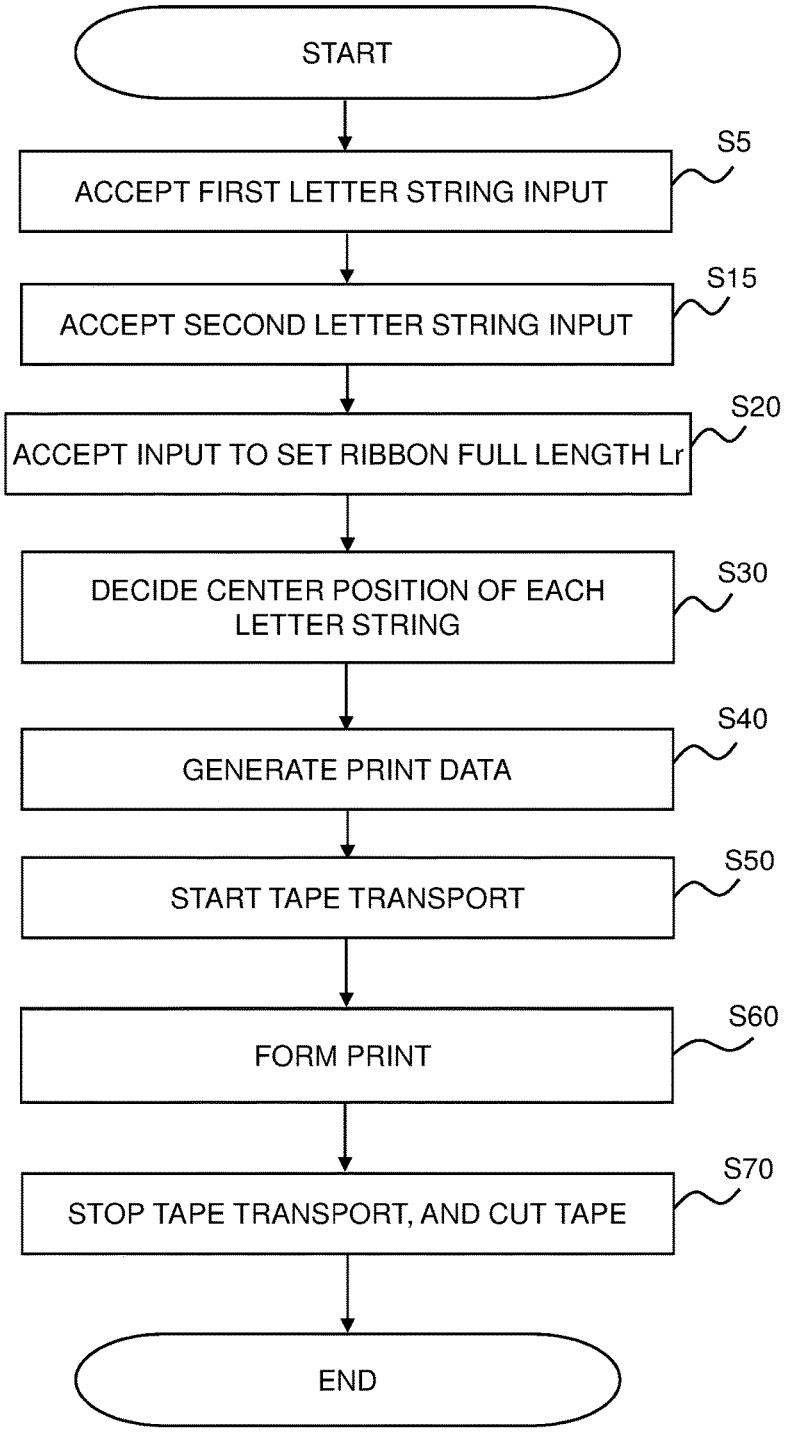

[FIG. 20]
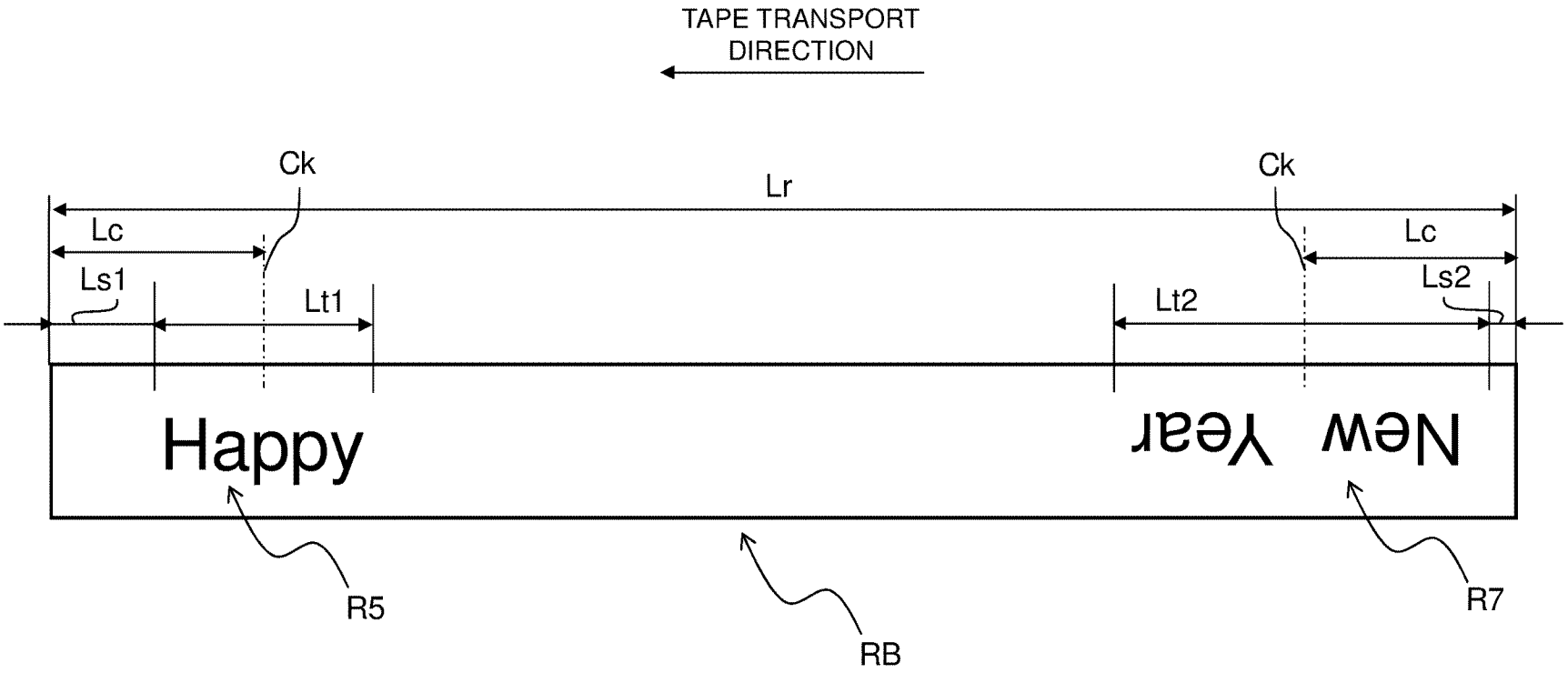

[FIG. 21]
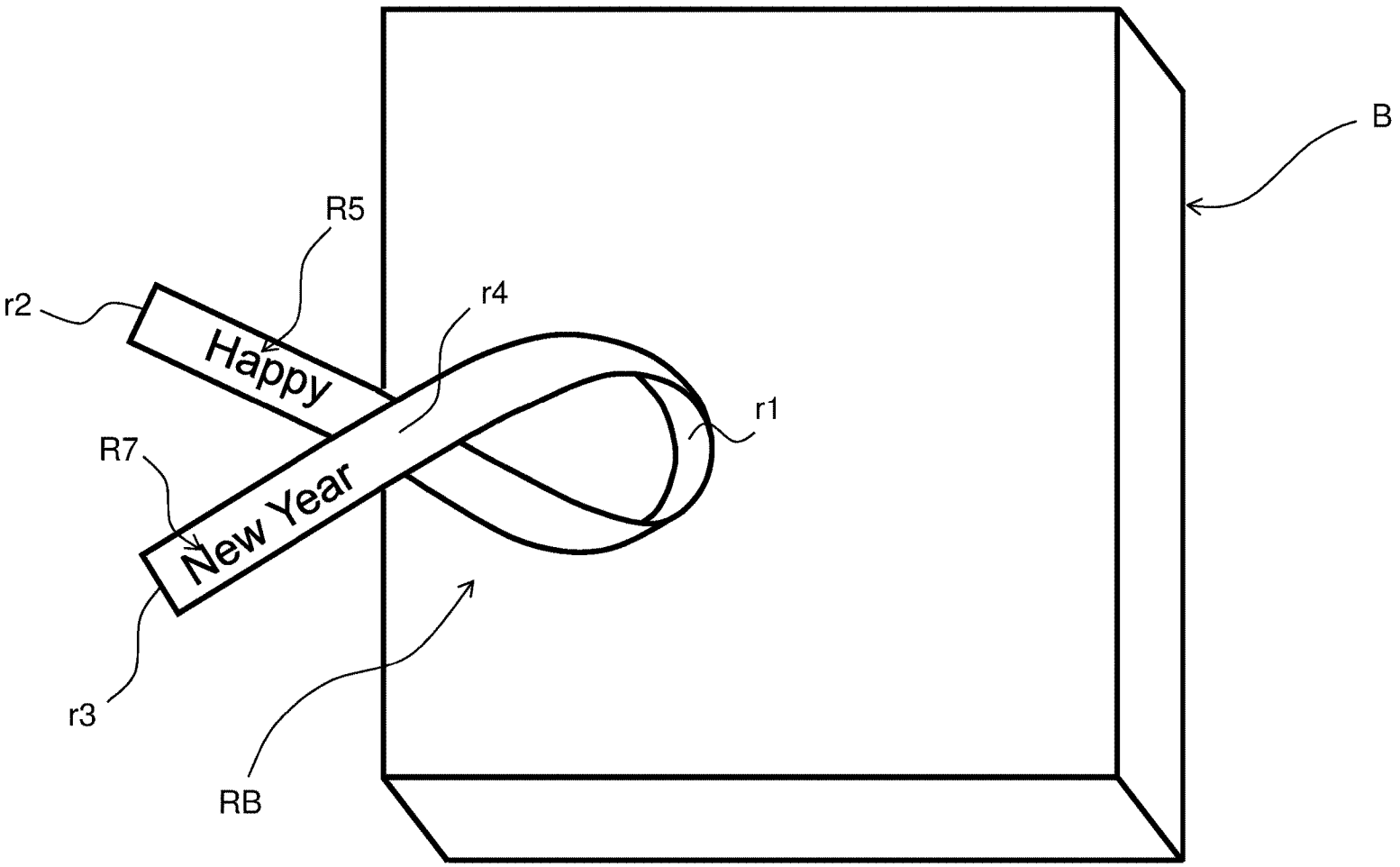

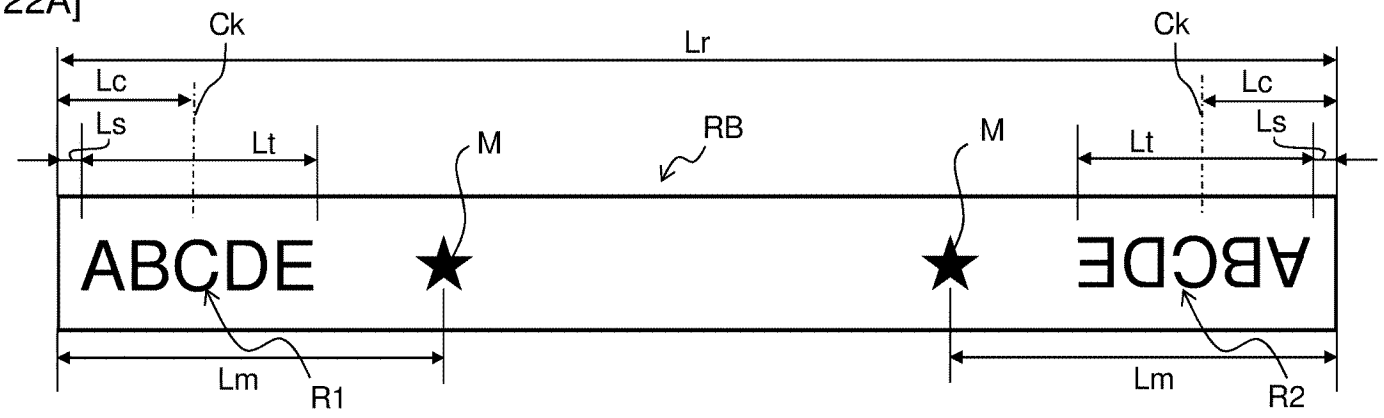
[FIG. 22A]
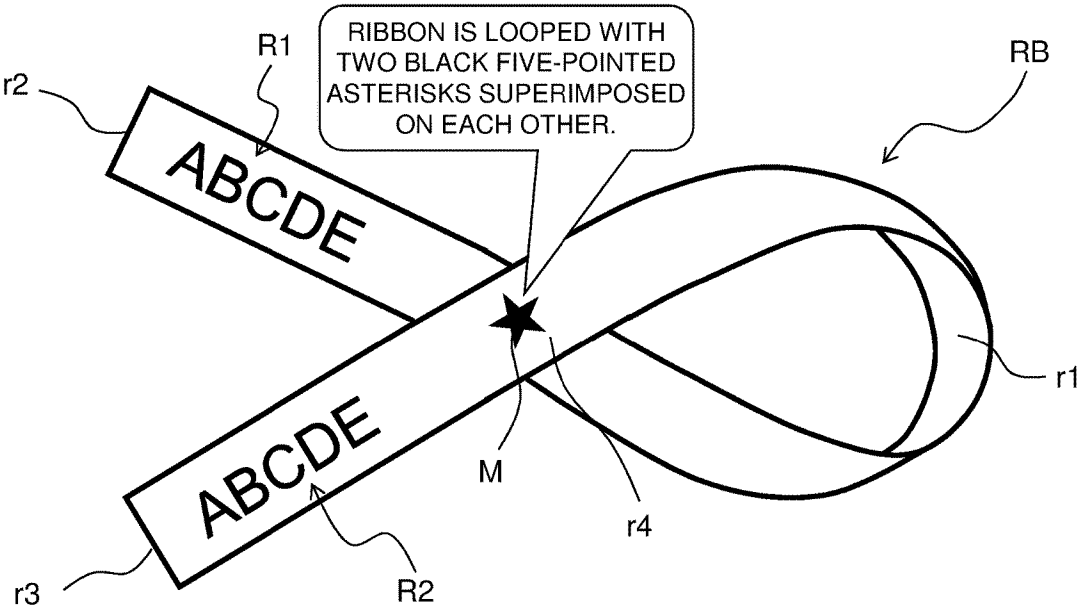
[FIG. 22B]

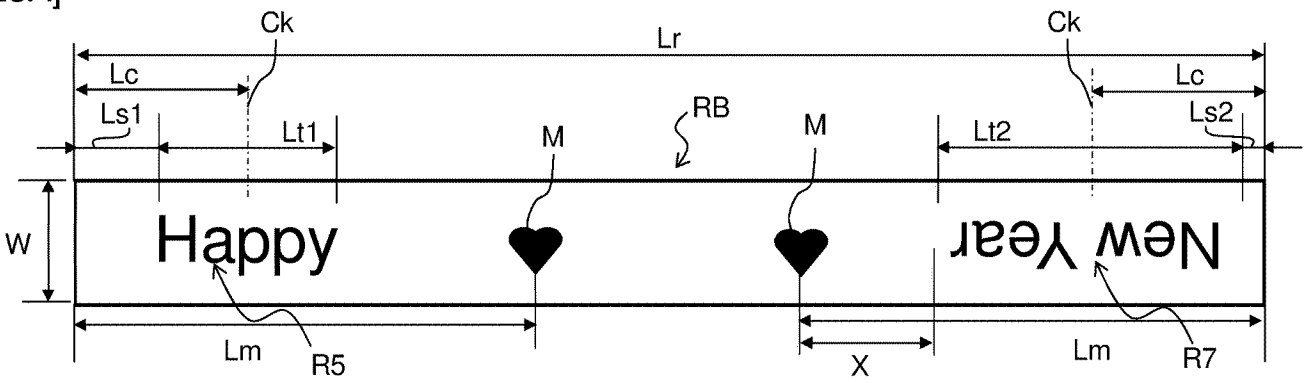
[FIG. 23A]
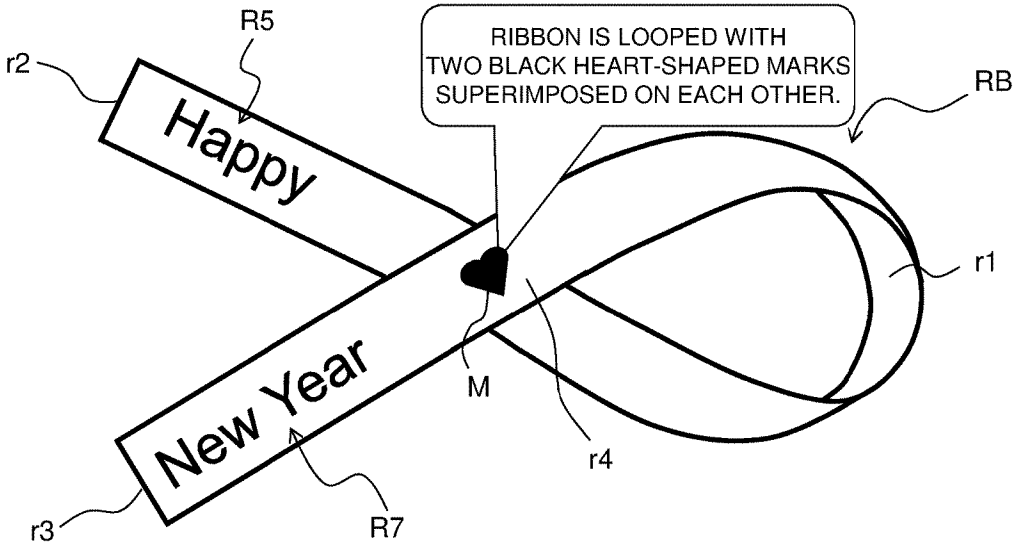
[FIG. 23B]

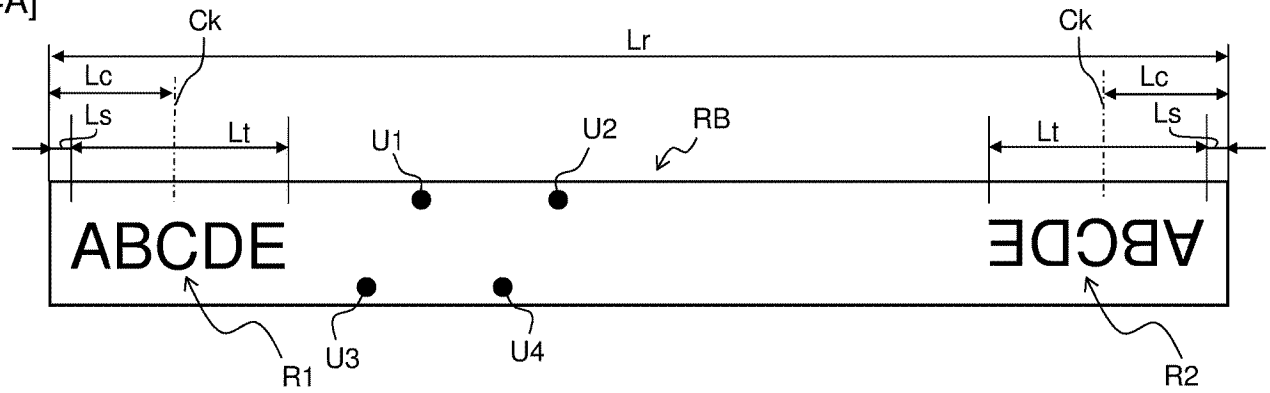
[FIG. 24A]
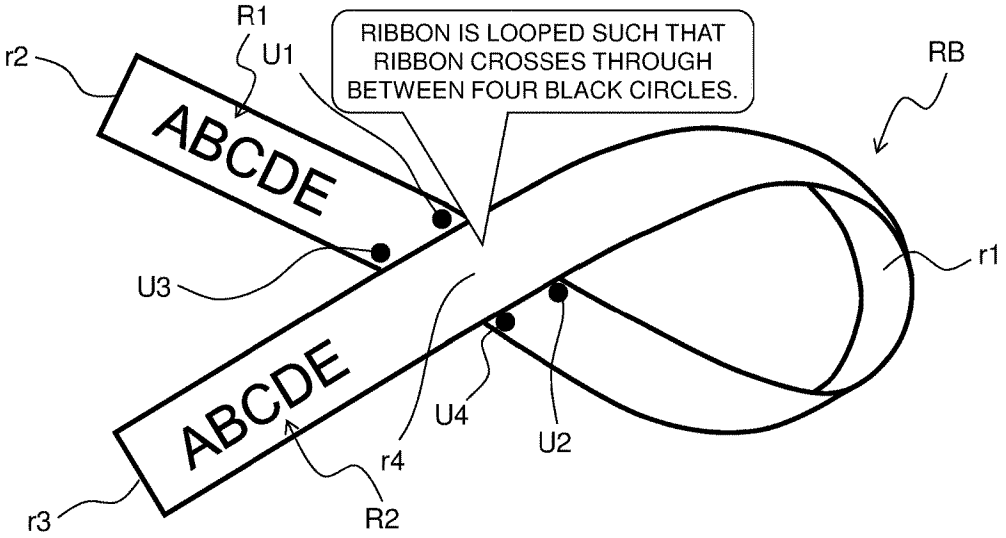
[FIG. 24B]

[FIG. 25]
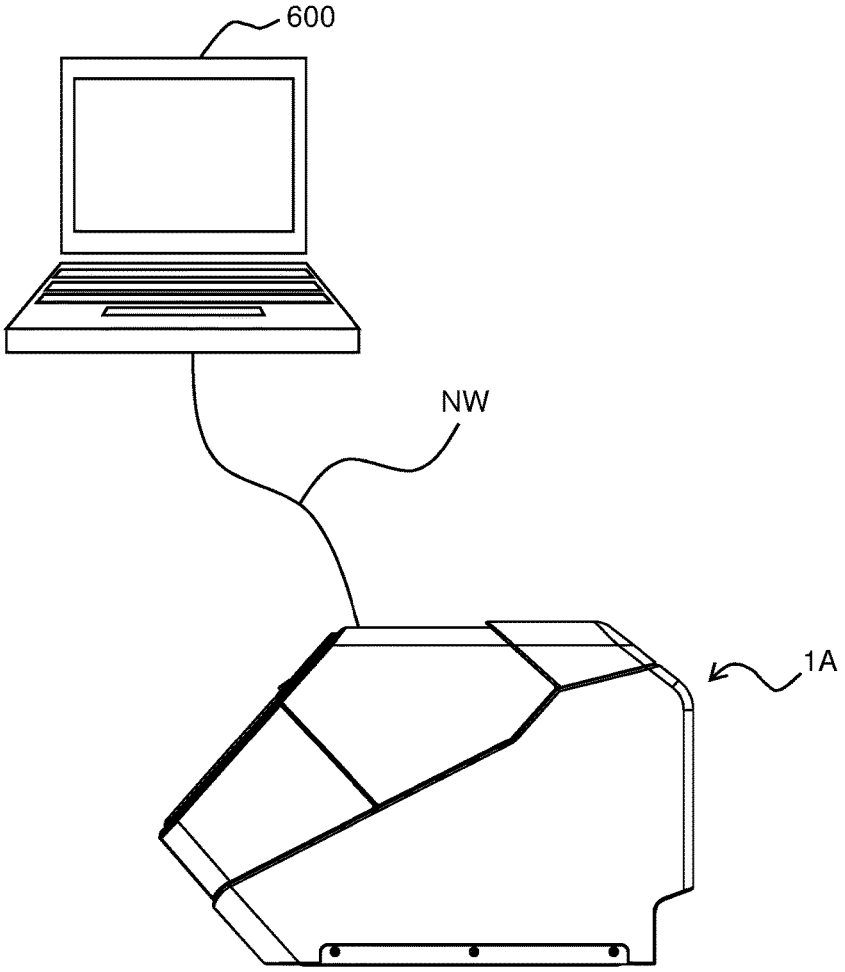

TAPE PRINTER AND RECORDING MEDIUM

CROSS-REFERENCE TO RELATED APPLICATION

The present application claims priority from Japanese Patent Application No. 2016-032770, which was filed on Feb. 24, 2016, the disclosure of which is incorporated herein by reference in its entirety.

BACKGROUND

Field

The present disclosure relates to a tape printer performing desired printing on a decorative print-receiving tape and to a recording medium storing a decorative tape production program for use in the tape printer.

Description of the Related Art

A printing device performing desired printing on a print-receiving tape has already been known. In this printing device, a light-transmitting print-receiving tape adhered circumferentially to an object to be adhered in the form of a wire rod or a bar has a printing area defined at an end edge portion so as to circumferentially overlie an opposite end edge portion forming a non-printing area. As a result, when adhered circumferentially to the object to be adhered such as the wire rod or the bar, the non-printing area at one end edge portion is adhered circumferentially to the printing area at the other end edge portion in an overlaid manner, so that the print durability in the printing area can be improved.

For printing, in the prior art printing device, the printing area is disposed only at one end edge portion on the assumption that the print-receiving tape is adhered circumferentially to the object to be adhered such as the wire rod or the bar.

On the other hand, printing for decorative purposes is often applied to a ribbon used in packing and packaging goods including a box or in bundling a plurality of wire rods, etc. In some cases, the printed decorative tape like this ribbon is bent (e.g. into a loop with vicinities of both end portions being superimposed on each other) in use by the user. The above prior art has not paid any special consideration for a print form enabling improvement of visual aesthetics in the vicinities of the tape ends that protrude to the left and right (or up and down) when bent as described above.

SUMMARY

It is therefore an object of the present disclosure to provide a tape printer and a decorative tape production program, capable of improving visual aesthetics in the vicinities of ends of a printed decorative tape when the tape is bent in use.

In order to achieve the above-described object, according to an aspect of the present disclosure, there is provided a tape printer comprising a feeder, a printing head, a letter string accepting portion, a full-length setting portion, a print data generating portion, and a coordination control portion. The feeder is configured to feed a decorative print-receiving tape. The printing head is configured to form print on the decorative print-receiving tape fed by the feeder, to produce a decorative tape with print. The letter string accepting portion is configured to accept input of one or two letter strings for forming pint on the decorative print-receiving tape. The full-length setting portion is configured to set a full length of the decorative tape with print. The print data generating portion is configured to generate print data in which two processed letter strings generated by applying predetermined decorative tape process to the one or two letter strings accepted by the letter string accepting portion are arranged at one end portion and another end portion of the decorative print-receiving tape in a tape length direction, the decorative print-receiving tape having the full length set by the full-length setting portion. The coordination control portion is configured to control the feeder and the printing head in coordination with each other using the print data generated by the print data generating portion, to produce the decorative tape with print having the full length.

BRIEF DESCRIPTION OF THE DRAWINGS

FIG. 1 is a perspective view showing an overall configuration of a tape printer according to a first embodiment of the present disclosure.

FIG. 2 is a perspective view showing an internal structure of the tape printer with a removable cover removed.

FIG. 3 is a plan view showing an internal structure of a cartridge.

FIG. 4 is a function block diagram showing a functional configuration of a control system.

FIG. 5 is a plan view showing an exemplary external appearance of a produced ribbon.

FIG. 6 is a view showing an example of use of the produced ribbon.

FIG. 7 is a view showing another example of use of the produced ribbon.

FIG. 8A is an explanatory view for explaining a ribbon production flow.

FIG. 8B is an explanatory view for explaining a ribbon production flow.

FIG. 8C is an explanatory view for explaining a ribbon production flow.

FIG. 8D is an explanatory view for explaining a ribbon production flow.

FIG. 8E is an explanatory view for explaining a ribbon production flow.

FIG. 9 is a flowchart showing a control procedure executed by a CPU.

FIG. 10 is a view showing a modification example where another decoration is further mounted on the ribbon.

FIG. 11 is a view showing an example of use of the ribbon.

FIG. 12A is a view showing a modification example where the ribbon is wound like a helmet.

FIG. 12B is a view showing the modification example where the ribbon is wound like the helmet.

FIG. 13A is a view showing a modification example where the ribbon is affixed to an end portion of a cylindrical target object.

FIG. 13B is a view showing the modification example where the ribbon is affixed to the end portion of the cylindrical target object.

FIG. 13C is a view showing the modification example where the ribbon is affixed to the end portion of the cylindrical target object.

FIG. 13D is a view showing the modification example where the ribbon is affixed to the end portion of the cylindrical target object.

FIG. 13E is a view showing the modification example where the ribbon is affixed to the end portion of the cylindrical target object.

FIG. 14A is an explanatory view for explaining a ribbon production flow in a modification example of a vertical letter string.

FIG. 14B is an explanatory view for explaining the ribbon production flow in the modification example of the vertical letter string.

FIG. 14C is an explanatory view for explaining the ribbon production flow in the modification example of the vertical letter string.

FIG. 14D is an explanatory view for explaining the ribbon production flow in the modification example of the vertical letter string.

FIG. 14E is an explanatory view for explaining the ribbon production flow in the modification example of the vertical letter string.

FIG. 15 is a view showing an example of use of a produced ribbon.

FIG. 16 is a plan view showing an exemplary external appearance of a ribbon produced in a second embodiment of the present disclosure.

FIG. 17 is a view showing an example of use of the produced ribbon.

FIG. 18A is an explanatory view for explaining a ribbon production flow.

FIG. 18B is an explanatory view for explaining the ribbon production flow.

FIG. 18C is an explanatory view for explaining the ribbon production flow.

FIG. 18D is an explanatory view for explaining the ribbon production flow.

FIG. 18E is an explanatory view for explaining the ribbon production flow.

FIG. 18F is an explanatory view for explaining the ribbon production flow.

FIG. 18G is an explanatory view for explaining the ribbon production flow.

FIG. 19 is a flowchart showing another control procedure executed by the CPU.

FIG. 20 is a plan view showing an exemplary external appearance of a ribbon produced in a third embodiment of the present disclosure.

FIG. 21 is a view showing an example of use of the produced ribbon.

FIG. 22A is a plan view showing an exemplary external appearance of a ribbon produced in a fourth embodiment of the present disclosure.

FIG. 22B is a view showing an example of use of the ribbon.

FIG. 23A is a plan view showing another exemplary external appearance of the produced ribbon.

FIG. 23B is a view showing an example of use of the ribbon.

FIG. 24A is a plan view showing a further exemplary external appearance of the produced ribbon.

FIG. 24B is a view showing an example of use of the ribbon.

FIG. 25 is an overall schematic view of a modification example employing a network configuration.

DETAILED DESCRIPTION OF THE PREFERRED EMBODIMENTS

Embodiments of the present disclosure will now be described with reference to the drawings. If there are notes "front", "rear", "left", "right", "top", and "bottom" in the following diagrams, the noted directions refer to frontward, rearward, leftward, rightward, upward, and downward, respectively, in explanations of the description.

A first embodiment of the present disclosure will be described with reference to FIGS. 1 to 15.

<Schematic External Structure of Device>

As shown in FIG. 1, a tape printer 1 is a so-called handheld-type tape printer grasped by the user's (operator's) hand. A housing 6 of the tape printer 1 includes a front cover 6A configuring the device front and a rear cover 6B configuring the device rear. The rear cover 6B includes a rear cover body 6B1 incorporating various mechanisms and a removable cover 6B2 removable from the rear cover body 6B1 when attaching or detaching a cartridge 31 (see FIG. 3 described later) or a battery (not shown).

The front cover 6A has on its upper side a display portion 550 for displaying various setting screens, etc. The display portion 550 has a front surface covered by a cover panel 2A in the form of e.g. a transparent acrylic plate. An operating portion 3 for operating the tape printer 1 is disposed on the lower side of the color panel 2A. The operating portion 3 includes keys of letters, symbols, numerals, etc., various function keys, and appropriate buttons. When the user enters the content to be print-formed through an operation of the operating portion 3, corresponding print data is generated and the content thereof is displayed on the display portion 550. The rear cover body 6B1 has at its right upper end a cut lever 4 for cutting a decorative print-receiving tape 301 (see FIG. 3 described later) on which print is formed as described above.

<Internal Structure of Device>

An internal structure of the tape printer 1 will be described with reference to FIG. 2. As shown in FIG. 2, a frame 13 molded of a resin for example is arranged inside the front cover 6A and the rear cover body 6B1. The frame 13 has at its rear upper part a recessed cartridge holder 7 that is rectangular in a planar view for attaching and detaching a cartridge 31 (see FIG. 3 described later).

A motor storage portion 5 for storing a driving motor (not shown) is disposed on the lower side of the cartridge holder. A battery storage portion 9 for storing a battery is disposed on the further lower side of the motor storage portion 5.

The frame 13 has at its upper part a discharge slit 24 for discharging the decorative print-receiving tape 301 (see FIG. 3 described later) to the exterior. The frame 13 has a roller holder 17 disposed at the upper right thereof. A plate-shaped synthetic resin plate portion 25 is disposed on the rear side of the roller holder 17 so as to cover the roller holder 17. The plate portion 25 has at its upper part a protrusion insertion port 10 that is an opening. The rear cover body 6B1 has a lock hole 11 disposed at an upper end portion thereof and has two lock holes 12 disposed at a lower end portion thereof.

The frame 13 has a concaved gear recess 26 formed at a substantial center thereof. A gear (not shown) is disposed in the gear recess 26 such that teeth of the gear are covered by a concealment umbrella portion 114 so as not to be exposed. A ribbon winding shaft 14 for winding an ink ribbon 55 (see FIG. 3 described later) stands on the rear side of the gear.

A rib 30 stands on the right side of the ribbon winding shaft 14. The rib 30 has on its right side surface a heat sink 15 that is a rectangular radiating plate. A roller shaft 20 stands between the rib 30 and the discharge slit 24. A raised portion 27 stands on the left side of the roller shaft 20. The raised portion 27 is fitted into a recessed portion (not shown) of the cartridge 31 to position the cartridge 31 in the front-rear direction.

The frame 13 has in the vicinity of the discharge slit 24 a guide holder 40 storing therein a cutter holder (not shown) with a cutter blade.

The frame 13 has a rib 42 integrally formed therewith in the vicinity of the discharge slit 24. The rib 42 formed on the right side of the discharge slit 24 extends vertically from a planar rear surface 25A of the plate portion 25.

<Cartridge Internal Structure>

An internal structure of the cartridge 31 will be described with reference to FIG. 3. As shown in FIG. 3, a ribbon spool 56 with the ink ribbon 55 wound therearound is rotatably arranged inside a cartridge case 33 at its lower left. The ink ribbon 55 fed out from the ribbon spool 56 is guided toward a cartridge opening 371.

A ribbon take-up spool 57 is rotatably arranged adjacent to the ribbon spool 56 on its diagonally upper left side. The ribbon take-up spool 57 pulls out the ink ribbon 55 from the ribbon spool 56 and takes up the ink ribbon 55 consumed by printing of letters or images. The cartridge 31 has at its upper left a decorative print-receiving tape roll 53 (designated as a simple circle in a simplified manner although it is originally spiral). The decorative print-receiving tape roll 53 is a roll of the decorative print-receiving tape 301 wound around a reel 54 with an axis extending in a direction (vertical to paper of FIG. 3) orthogonal to the tape length direction. The decorative print-receiving tape 301 is a ribbon tape (tape for producing a ribbon RB for decorative purposes described later) in the form of a decorative tape with print made of a fabric material and is a print-receiving material whose surface is superimposed on the ink ribbon 55 to receive print by heat transfer of ink.

The roller holder 17 of an arm shape having a platen roller unit 18 and a discharge roller unit 19 is disposed swingably in left-right direction around a shaft support 171 on the right side of the cartridge 31 mounted in the cartridge holder 7. When the removable cover 6B2 is attached, the roller holder 17 moves toward the cartridge 31 due to the presence of a protrusion (not shown). As a result, the platen roller unit 18 and discharge roller unit 19 disposed on the roller holder 17 move to a print position (position designated in FIG. 3).

The platen roller unit 18 is disposed on the right side of the heat sink 15. The platen roller unit 18 includes a platen roller 182 (equivalent to a feeder) and a platen roller gear (not shown). The platen roller 182 is disposed at a position facing a thermal head 16 (equivalent to a printing head) disposed on a right side surface of the heat sink 15.

The thermal head 16 comprises a plurality of heat generating elements and forms desired print on the decorative print-receiving tape 301 transported by a discharge roller 192, the platen roller 182, etc. The platen roller gear is engaged with a gear (not shown) disposed on the front side of the frame 13 so that rotation of the platen roller gear powered from the driving motor causes the platen roller 182 to rotate. As a result, when the platen roller unit 18 moves to the print position, the platen roller 182 feeds, by its rotation, the decorative print-receiving tape 301 toward the discharge roller unit 19 while pressing the decorative print-receiving tape 301 and the ink ribbon 55 against the thermal head 16.

The discharge roller unit 19 comprises the discharge roller 192 and a discharge roller gear (not shown). The discharge roller 192 is disposed at a position facing the roller shaft 20 and transports the decorative print-receiving tape 301 along a transport path (see arrows a, b, and c in FIG. 3) extending toward the discharge slit 24. The roller shaft 20 includes a cylindrical portion 201 shaped into a cylinder and six ribs 202 extending radially outwardly from the outer circumference of the cylindrical portion 201. The roller shaft 20 is fitted into a shaft hole 391 of a feeding roller 39 disposed on the cartridge 31, so as to rotatably support the feeding roller 39.

The discharge roller gear is engaged with a gear (not shown) disposed on the front side of the frame 13 so that rotation of the discharge roller gear powered from the drive motor causes the discharge roller 192 to rotate. As a result, when the discharge roller unit 19 moves to the print position, the discharge roller 192 presses the decorative print-receiving tape 301 against the feeding roller 39 rotatably supported on the roller shaft 20. This allows the decorative print-receiving tape 301 on which print is formed by the thermal head 16 as described above to be discharged from a discharge port 59. The subsequent transport path of the decorative print-receiving tape 301 is such that the decorative print-receiving tape 301 is transported and guided to the discharge slit 24 by the discharge roller 192, etc. and is discharged through the discharge slit 24 to the exterior of the tape printer 1. The user then operates the cut lever 4 so that the decorative print-receiving tape 301 is cut by the cutter blade. The decorative print-receiving tape 301 is printed and cut as described above to produce the ribbon RB (equivalent to the decorative tape with print; see FIG. 5 described later) for packing, bundling, or decorating a target object.

<Functional Structure of Control System>

FIG. 4 shows a functional configuration of a control system in the tape printer 1.

Referring to FIG. 4, the tape printer 1 comprises a control portion 530 that includes for example a microprocessor (not shown in particular) having a CPU, a RAM and a ROM (EEPROM, etc.). The control portion 530 connects via an I/O interface 560 to a drive system 540, the display portion 550, and the operating portion 3, the drive system 540 including a motor drive circuit (not shown) controlling drive of the drive motor and a thermal head drive circuit (not shown) controlling energization of the thermal head 16.

Feature of this Embodiment

The greatest feature of this embodiment lies in that when the decorative print-receiving tape 301 is printed and cut to produce the ribbon RB as described above, the printing indication form is such that a letter string at one end portion of the ribbon RB is rotated 180 degrees from a letter string at the other end portion thereof. The details thereof will hereinafter be described in due course.

<External Appearance of Ribbon>

FIG. 5 is a plan view showing an exemplary external appearance of the ribbon RB printed and produced by the tape printer 1 having the above configuration. As seen from FIG. 5, the ribbon RB is produced in such a manner as to have a full length Lr optionally set by the user as described later.

The ribbon RB of this example has "ABCDE" as a letter string R1 (equivalent to a third letter string) at a downstream end portion in the tape transport direction (one end portion in the tape length direction; a left end portion in the diagram). At that time, the letter string R1 is printed having a print length Lt, with letters "A", "B", "C", "D", and "E" standing upright in an array direction (equivalent to a first array direction) where the letters are juxtaposed from right to left of the diagram in the tape length direction. Ls is a margin length from a downstream end (one end in the tape length direction; a left end in the diagram) to the downstream end (left end in the diagram) and Lc is a separation length from a center Ck of the letter string R1 in the tape length direction to the downstream end of the ribbon RB.

The ribbon RB has "ABCDE" as a letter string R2 (also equivalent to the third letter string) at an upstream end portion (the other end portion in the tape length direction; a right end portion in the diagram), the letter string R2 having a form in which the letter string R1 is rotated just 180 degrees. As a result, the letter string R2 is printed having the print length Lt equal to that of the letter string R1, with the letters "A", "B", "C", "D", and "E" being inverted in an array direction (equivalent to a second array direction) where the letters are juxtaposed from right to the left of the diagram in the tape length direction. The ribbon RB has a margin length Ls, equal to that of the letter string R1, from an upstream end (the other end in the tape length direction; a right end in the diagram) to the upstream end (right end in the diagram) and has a separation length Lc, equal to that of the letter string R1, from the center Ck of the letter string R2 in the tape length direction to the upstream end of the ribbon RB.

Use Examples

FIG. 6 shows an example of use of the thus printed and produced ribbon RB. In FIG. 6, the ribbon RB is affixed to a corner surface of a box B that is a target object, the ribbon RB being generally curved with its print surfaces at both ends portion bent (crossed in loop in this example) facing up. In use, the user superimposes both end portion vicinities of the ribbon RB on each other into a loop, and then adheres the ribbon RB at a loop position r1 to a corner (lower left corner in this shown example) of the box B that is the target object. At that time, two tape end portion vicinity parts r2 and r3 (equivalent to both tape end portion vicinity parts) protruding from a crossing part r4 of the ribbon RB to both end sides of the ribbon RB have a form protruding from the corner of the box B to the exterior of the box B (i.e. into the air). Since the two letter strings R1 and R2 have a print content rotated 180 degrees from each other as described above, both the letter strings R1 and R2 can have a form as shown where their respective letters are visually oriented in the same direction (indication form where their respective letters stand substantially upright). Since the letter strings R1 and R2 have the same separation length Lc from the center Ck of the letter strings in the tape length direction to the extremities of the ribbon RB as described above, the letter strings R1 and R2 can be arranged on the ribbon RB at apparently substantially the same position.

FIG. 7 shows another example of use of the ribbon RB. In this case also, the ribbon RB is affixed to a corner surface of the box B that is a target object, crossed in loop in the same manner as the above. In this case, however, in use, the user superimposes the both end portion vicinities of the ribbon RB on each other into a loop, and then affixes the crossing part r4 to a corner (an upper right corner of the diagram in this example) of the box B that is a target object. At that time, two tape end portion vicinity parts r2 and r3 are affixed to the box B at positions in the inner (lower left in the diagram) vicinity of the corner. On the other hand, the loop position r1 protrudes from the corner of the box B to the exterior of the box B (i.e. into the air).

Similar to the above, in this case also, the two letter strings R1 and R2 have a print content rotated 180 degrees from each other, and hence the letter strings R1 and R2 can have a form as shown where their respective letters are visually oriented in the same direction and can be arranged on the ribbon RB at apparently substantially the same position.

<Print Label Production Flow>

Referring then to FIGS. 8A to 8E, description will be given of a flow along which the ribbon RB is produced using the tape printer 1.

<Input of Text Letter>

For example, as shown in FIG. 8A, the user (operator) properly operates the operating portion 3 such as the keyboard, to allow the display portion 550 such as a liquid crystal display to display a text edit screen 5A for the input of text letters, etc. At that time, the text edit screen displays a message "Input text" prompting a user's input instruction. In this state, as shown in FIG. 8B, the user inputs text letters using the operating portion 3. In this example, one letter string "ABCDE" (equivalent to the third letter string) including five text letters is input.

<Input to Set Ribbon Full Length>

Subsequently, as shown in FIG. 8C, the user properly operates the operating portion 3, etc. to allow the text edit screen 5A (or which may be another screen or another window, etc.) to display a confirmation message "Set ribbon full length". In this state, as shown in FIG. 8D, the user inputs the full length Lr (see FIG. 5) of the ribbon RB using the operating portion 3, in response to the confirmation message. In this example, setting of Lr=300 mm is input.

The user then presses a proper button key (a "Print" key in this example) disposed on the operating portion 3, to produce a print ribbon RB of full length Lr=300 mm having the upright letter string R1 of "ABCDE" on one end (left end in the diagram) side and the inverted letter string R2 of "ABCDE" which is rotated 180 degrees on the other end (right end in the diagram) side, as described above with reference to FIG. 5 (see FIG. 8E).

<Content of Control Executed by CPU of Control Portion>

Referring then to FIG. 9, a control procedure will be described that is executed by a CPU (particularly not shown) included in the control portion 530 of the tape printer 1, for implementing the above technique. Processes shown in this flow start to be executed when the user inputs a proper instruction to produce the ribbon RB for example through the operating portion 3.

First, at step S10, the CPU accepts an input of a letter string (one letter string R1 in the form of "ABCDE" in the above example) by the user's operation input via the operating portion 3.

Subsequently, the procedure shifts to step S20 at which the CPU accepts an input to set the ribbon full length Lr that is any value, by the user's operation input via the operating portion 3.

The procedure then shifts to step S30 at which the CPU decides, based on the ribbon full length Lr set at step S20, one letter string R1 input at step S10, another letter string R2 rotated 180 degrees therefrom as described above, and their respective center positions (positions of the centers Ck in the tape length direction; in other words, the separation length Lc). The margin length Ls is automatically decided from the print length Lt defined by e.g. the number of letters of the letter strings R1 and R2 and from the positions of the respective centers Ck of the letter strings R1 and R2.

Thereafter, the procedure shifts to step S40 at which the CPU generates print data for forming print on the ribbon, based on the results of acceptance and the result of decision at steps S10 to S30. Specifically, the decorative tape process includes generating print data where the letter string R1 with upright letters is arranged such that the center Ck corresponding thereto is apart the separation length Lc from one end in the tape length direction, whereas the letter string R2 with inverted letters (in other words, rotated 180 degrees from the letter string R1) such that the center Ck corresponding thereto is apart the separation length Lc from the other end in the tape length direction.

The procedure then shifts to S50 at which the CPU starts to produce the ribbon RB. Specifically, the CPU drives the drive motor by way of the motor drive circuit to start transporting the decorative print-receiving tape 301.

Afterword, the procedure shifts to step S60 at which the CPU forms print on the transported decorative print-receiving tape 301. More specifically, the CPU energizes the thermal head 16 by way of the thermal head drive circuit to form the letter string R1 of "ABCDE" in the range of the print length Lt at the downstream end portion and simultaneously form the letter string R2 of 180-degrees-rotated "ABCDE" in the range of the print length Lt at the upstream end portion.

The procedure then shifts to step S70 at which the CPU terminates the production of the ribbon RB. Specifically, the CPU stops the drive of the drive motor by way of the motor drive circuit to stop the transport of the decorative print-receiving tape 301, after which the display portion 550 performs a proper display (not shown) displaying the print completion and performs a display (not shown) prompting the user to cut the decorative print-receiving tape 301 by the operation of the cut lever 4. This flow then comes to an end.

At step S20, the user's input to set the full length Lr may be omitted by automatically setting the full length of the ribbon RB so that, for example, the separation length (equivalent to Lr−(Ls+Lt)−(Ls+Lt) in the above example; see FIG. 5) between the two letter strings R1 and R2 is a fixed value (e.g. 100 mm). In this case, CPU's automatic setting function is equivalent to a full-length setting portion as defined in claims.

In the above, the CPU executing the process at step S10 functions as a letter string accepting portion defined in claims; the CPU executing the process at step S20 functions as the full-length setting portion defined in claims; the CPU executing steps S30 and S40 functions as a print data generating portion defined in claims; and the CPU executing steps S50 to S70 functions as a coordination control portion defined in claims.

This first embodiment is not limited to the above form and could variously be modified without departing from the sprit and technical idea thereof. Hereinafter, such modification examples will be described in due course. In the modification examples, parts equivalent to those in the first embodiment are designated by the same reference numerals, and explanations thereof will properly be omitted or simplified.

(1-1) Case of Attaching Additional Decoration to Ribbon

For example, as shown in FIGS. 10 and 11, a seal S with a motif of "fish" may be attached to the ribbon RB at the loop position r1. The example of FIG. 10 shows a form where the entire ribbon RB including the loop position r1 with the seal S attached thereto apparently lies on the box B without extending to the outside of the box B. The example shown in FIG. 11 is an example, similar to FIG. 6, where the loop position r1 of the ribbon RB with the seal S attached thereto apparently lies on the box B whereas the crossing part r4 and the tape end portion vicinity parts r2 and r3 protrude to the outside of the box B (i.e. into the air).

(1-2) Helmet Winding

In this modification example, as another looped shape shown in FIGS. 12A and 12B, the ribbon RB is used in the form of a so-called helmet winding (a form where the ribbon RB is tied once in the middle). In this case, in a posture shown in FIG. 12A for example, the end portion vicinity part r2 lies on the left end side in the diagram with the letter string R1 of "ABCDE" being arranged and visually recognized on the front side (near side with respect to the diagram) from the viewpoint shown, whereas the end portion vicinity part r3 lies on the right end side in the diagram with the letter string R2 of "ABCDE" being arranged but visually not recognized on the back side (far side with respect to the diagram) from the viewpoint shown (for the sake of convenience, virtually drawn in a lighter color in the diagram).

When rotated while drawing the end portion vicinity part r3 toward the near side (in other words, turned over and mirror-reversed) as indicated by a thick broken line from the posture of FIG. 12A, the ribbon RB takes a posture shown in FIG. 12B. In this case, the end portion vicinity part r3 is positioned on the left end side of the diagram so that the letter string R2 of "ABCDE" (which is equal in content to the letter string R1) is arranged and becomes visible on the front side (near side with respect to the diagram), whereas the end portion vicinity part r2 is positioned on the right end side of the diagram so that the letter string R1 becomes invisible. Thus, at any rotational position, the letter string of "ABCDE" can be visible at all times on the left end side of the diagram.

(1-3) Case of Affixing to End of Cylindrical Target Object

In this modification example, another looped form is shown in FIGS. 13A to 13E where the ribbon RB is bent into a U shape and affixed wound around the end portion of an elongated cylindrical target object P along the length direction (direction of a cylinder axis C). FIGS. 13A to 13E are diagrams shown for the sake of clarity of the configuration such that the target object P with the ribbon RB affixed thereto is circumferentially rotated in the order of FIG. 13A→FIG. 13B→FIG. 13C→FIG. 13D→FIG. 13E (see arrows of thick broken lines), rendering the whole circumference visible.

In the state shown in FIG. 13A, one side of the U shape, i.e. the end portion vicinity part r2 having the letter string R1 of "ABCDE" is arranged on the front side (near side with respect to the diagram) from the shown viewpoint. At that time, the other side of the U shape, i.e. the end portion vicinity part r3 similarly having the letter string R2 of "ABCDE" is arranged on the back side (far side with respect to the diagram) from the shown viewpoint. When rotated from this state in a direction (i.e. circumferential direction) indicated by the thick broken line, the state shifts, through FIG. 13B, to FIG. 13C rotated 90 degrees from the state of FIG. 13A. As shown, the end portion vicinity part r2 having the letter string R1 and the end portion vicinity part r3 having the letter string R2 lie on one side and on the other side, respectively, of the U shape.

When further rotated from the state of FIG. 13C toward a direction (i.e. circumferential direction) indicated by the thick broken line, the ribbon RB shifts, through the state of FIG. 13D, to the state of FIG. 13E rotated 90 degrees from the state of FIG. 13C. In the state of FIG. 13E, the end portion vicinity part r3 having the letter string R2 is arranged on the front side (near side with respect to the diagram) from the shown viewpoint, whereas the end portion vicinity part r2 having the letter string R1 is arranged on the back side (far side with respect to the diagram) from the shown viewpoint.

(1-4) Case of Letter String in Vertical Writing

A production flow of the ribbon RB in this modification example will be described with reference to FIGS. 14A to 14E corresponding to FIGS. 8A to 8E of the embodiment. In this modification example, as shown in FIG. 14B corresponding to FIG. 8B by way of FIG. 14A corresponding to FIG. 8A, the user inputs the letter string "ABC" (equivalent to the third letter string) including three text letters on the text edit screen 5A, similar to the above. Thereafter, in FIG. 14D corresponding to FIG. 8D by way of FIG. 14C corresponding to FIG. 8C, the user inputs setting of the full length Lr=300 mm, similar to the above.

In this modification example, similar to the above, a proper button/key ("Print" key in this example) included in the operating portion 3 is pressed to produce a print ribbon RB of full-length Lr=300 mm having a letter string R3 of "ABC" in vertical writing on one end (left end in the diagram) side and having a letter string R4 of "ABC" in vertical writing, rotated 180 degrees from the letter string R3, on the other end (right end in the diagram) side (see FIG. 14E). In more detail, the letter string R3 is printed with a proper print length Lt (not shown) in an array direction (equivalent to a first array direction in this modification example) where the letters "A", "B", and "C" stand upright toward 90 degrees right side in the diagram and are juxtaposed side by side from right to left of the diagram in the tape length direction. Similarly, the letter string R4 is printed with the print length Lt (not shown) in an array direction (equivalent to a second array direction in this modification example) where the letters "A", "B", and "C" stand upright toward 90 degrees left side in the diagram and are juxtaposed side by side from left to right of the diagram in the tape length direction.

In the case of using the above ribbon RB, as shown in FIG. 15 for example, the user superimposes the both end portion vicinities of the ribbon RB on each other into a loop, similar to the above, and then affixes the ribbon RB at the loop position r1 to the box B that is a target object at its center. At that time, the tape end portion vicinity parts r2 and r3 protrude from an edge (lower edge in the diagram) of the box B to the exterior of the box B (i.e. into the air). Although not shown and not described in detail in FIGS. 14 and 15, also in the ribbon RB of this modification example, the letter strings R3 and R4 have the same separation length Lc from the centers Ck of the respective letter strings in the tape length direction to the corresponding ends of the ribbon RB, similar to the first embodiment.

A second embodiment of the present disclosure will be described with reference to FIGS. 16 to 19. This embodiment is an embodiment in which the ribbon RB is produced, without the above-described rotation of the letter strings, using the tape printer 1 having the same configuration as the above. Equivalent parts to those of the first embodiment and its modification examples described above are designated by the same reference numerals, and explanations thereof will appropriately be omitted or simplified.

<External Appearance of Ribbon>

In this embodiment, FIG. 16 is a plan view showing an exemplary external appearance of the produced ribbon RB with print. In FIG. 16, the ribbon RB is produced with a full length Lr (which may be the same as the first embodiment or may be a different value), similar to the above. In the shown example, a letter string R5 (equivalent to the first letter string) of "Happy" is arranged on the ribbon RB at a downstream end portion (one end portion in the tape length direction; left end portion in the diagram) in the tape transport direction. At that time, the letter string R5 is printed having a print length Lt1 with letters "H", "a", "p", "p", and "y" standing upright and arrayed side by side from left to right in the diagram. Ls1 is imparted to a margin length from a downstream end (one end in the tape length direction; left end in the diagram) of the ribbon RB to the downstream end (left end in the diagram) of the letter string R5, while Lc (the same value as in the first embodiment) is imparted to a separation length from a center Ck of the letter string R5 in the tape length direction to the downstream end (one end in the tape length direction) of the ribbon RB.

A letter string R6 (equivalent to the second letter string) of "New Year" is arranged on the ribbon RB at an upstream end (the other end in the tape length direction; right end in the diagram) in the tape transport direction. The letter string R6 is printed having a print length Lt2 that is longer than the print length Lt1 of the letter string R5, with letters "N", "e", "w", "Y", "e", "a", and "r" standing upright and arrayed side by side from left to right in the diagram. At that time, the same Lc as that of the letter string R5 is imparted to a separation length from a center Ck of the letter string R6 in the tape length direction to the upstream end (the other end in the tape length direction) of the ribbon RB, with the result that a margin length from an upstream end (the other end in the tape length direction; right end in the diagram) of the ribbon RB to the upstream end (right end in the diagram) of the letter string R6 becomes Ls2 that is shorter than the margin length Ls1 of the letter string R5.

Use Example

FIG. 17 shows an example of use of the thus printed and produced ribbon RB. In FIG. 17, the ribbon RB is affixed to the box B that is the target object at its lower edge part, the ribbon RB being generally curved with its print surfaces at both end portions bent (crossed in loop in this example) facing up, similar to the first embodiment. In use, the user loops the ribbon RB with its end portion vicinities being superimposed on each other and then adheres the ribbon RB at the loop position r1 to the box B that is the target object at the vicinity of a center thereof. At that time, the two tape end portion vicinity parts r2 and r3 (equivalent to both the tape end portion vicinity parts) protruding from the crossing part r4 of the ribbon RB to both end sides of the ribbon RB have a form protruding from the edge part of the box B to the exterior of the box B (i.e. into the air).

<Print Label Production Flow>

Referring then to FIGS. 18A to 18G, description will be given of a flow along which the ribbon RB of this embodiment is produced.

<Text Letter Input>

For example, first as shown in FIG. 18A, similar to FIG. 8A of the first embodiment, the text edit screen 5A is displayed on the display portion 550 by a user's proper operation. At that time, a message "Input first text" prompting a user's input instruction appears on the text edit screen 5A. In this state, as shown in FIG. 18B, the user inputs text letters using the operating portion 3. In this example, one letter string "Happy" (equivalent to the first letter string) including five text letters is input.

Subsequently, as shown in FIG. 18C, the user properly operates the operating portion 3, etc. to allow the text edit screen 5A to display a message "Input second text" prompting a user's input instruction. In this state, as shown in FIG. 18D, the user inputs text letters using the operating portion 3. In this example, one letter string "New Year" (equivalent to the second letter string) including seven text letters is input.

<Input to Set Ribbon Full Length>

Afterward, as shown in FIG. 18E, similar to FIG. 8C of the first embodiment, a confirmation message "Set ribbon full length" appears on the text edit screen 5A (or which may be a different screen or a different window, etc.) through a user's proper operation of the operating portion 3, etc. In this state, as shown in FIG. 18F, similar to FIG. 8D of the first embodiment, the user inputs the full length Lr (see FIG. 16) of the ribbon RB using the operating portion 3, in response to the confirmation message. In this example, setting of Lr=300 mm is input.

The user then presses a proper button key (the "Print" key in this example) disposed on the operating portion 3, to produce a print ribbon RB of full length Lr=300 mm having the letter string R5 of "Happy" on one end (left end in the diagram) side and the letter string R6 of "New Year" on the other end (right end in the diagram) side, as described above with reference to FIG. 16 (see FIG. 18G).

<Content of Control Executed by CPU of Control Portion>

Referring then to FIG. 19, a control procedure will be described that is executed by a CPU (particularly not shown) included in the control portion 530 of the tape printer 1 of this embodiment for implementing the above technique. Steps equivalent to those in FIG. 9 are designated by the same step numbers. Processes shown in this flow start to be executed when the user inputs an instruction to produce the ribbon RB for example through the operating portion 3.

In the flow of FIG. 19, step S10 of FIG. 9 is replaced by newly added steps S5 and S15. First, at step S5, the CPU accepts input of a first letter string (one letter string R5 of "Happy" in the above example) through a user's operation input using the operating portion 3.

Subsequently, at step S15, First, the CPU accepts input of a second letter string (one letter string R6 of "New Year" in the above example) through a user's operation input using the operating portion 3.

Thereafter, the CPU accepts input to set the ribbon full length Lr at step S20 similar to that in FIG. 9, after which the procedure shifts to step S30 similar to that in FIG. 9. It is to be noted that at step S30 of this embodiment, the CPU decides center positions (positions of the centers Ck in the tape length direction; in other words, the separation lengths Lc) of the two letter strings R5 and R6 input at steps S5 and S15, based on the ribbon full length Lr set at step S20. The above-described margin lengths Ls1 and Ls2 are automatically decided from the print lengths Lt1 and Lt2 defined by e.g. the number of letters of the letter strings R5 and R6 and from the decided positions of the respective centers Ck of the letter strings R1 and R2.

Thereafter, the procedure shifts to step S40 similar to that in FIG. 9, at which the CPU generates print data for forming print on the ribbon, based on the results of acceptance and the result of decision at steps S15, S20, and S30. It is to be noted in this embodiment that as described above, there is generated print data in which, as decorative tape process, as described above, the letter string R5 is arranged such that the corresponding center Ck is apart the separation length Lc from one end in the tape length direction while the letter string R6 different in content from the letter string R5 is arranged such that the corresponding center Ck is apart the separation length Lc from the other end in the tape length direction.

Afterward, at step S60 by way of step S50 similar to that in FIG. 9, the CPU forms print on the transported decorative print-receiving tape 301. The CPU energizes the thermal head 16 via the thermal head drive circuit, to form the letter string R5 of "Happy" in the range of the print length Lt1 at the downstream end portion while simultaneously forming the letter string R6 of "New Year" in the range of the print length Lt2 at the upstream end portion. The subsequent step S70 is similar to that in the first embodiment and will not again be described.

The user's input to set the full length Lr at step S20 may be omitted, and instead, the full length of the ribbon RB may automatically be set so that for example, the separation length (equivalent to Lr−(Ls1+Lt1)−(Ls2+Lt2) in the above example; see FIG. 16) between the two letter strings R5 and R6 results in a predetermined fixed value (e.g. 100 mm). In this case, this CPU's automatic setting function is equivalent to the full-length setting portion as defined in claims.

In the above, the CPU executing the processes at steps S5 and S15 functions as the letter string accepting portion defined in claims; the CPU executing the process at step S20 functions as the full-length setting portion defined in claims; the CPU executing the processes at steps S30 and S40 functions as the print data generating portion defined in claims; and the CPU executing the processes at steps S50 to S70 functions as the coordination control portion defined in claims.

A third embodiment of the present disclosure will be described with reference to FIGS. 20 and 21. This embodiment is an embodiment in which the ribbon RB is produced with letter strings being rotated as in the first embodiment when two letter strings each having different content are arranged as in the second embodiment. Parts equivalent to those in the first embodiment, second embodiment, and modification examples described above are designated by the same reference numerals, and explanations thereof will properly be omitted or simplified.

<External Appearance of Ribbon>

In this embodiment, FIG. 20 is a plan view showing an exemplary external appearance of the produced ribbon RB with print. In FIG. 20, the ribbon RB is produced with a full length Lr (which may be the same as in the first embodiment and the second embodiment or may be a different value), similar to the above. In the shown example, similar to the second embodiment, the letter string R5 (equivalent to a fourth letter string) of "Happy" is arranged on the ribbon RB at a downstream end portion (one end portion in the tape length direction; left end portion in the diagram) in the tape transport direction and, as described above, is printed (the print length Lt1) with letters "H", "a", "p", "p", and "y" standing upright in an array direction (equivalent to a first array direction) where the letters are juxtaposed side by side from left to right of the diagram in the tape length direction. The same lengths as in the second embodiment are applied to the margin length Ls1 from the downstream end (one end in the tape length direction; left end in the diagram) of the ribbon RB to the downstream end (left end in the diagram) of the letter string R5 and to the separation length Lc from the center Ck of the letter string R5 in the tape length direction to the downstream end (one end in the tape length direction) of the ribbon RB.

On the other hand, the ribbon RB has, at its upstream end portion (the other end portion in the tape length direction; right end portion in the diagram) in the tape transport direction, a letter string R7 (equivalent to a fifth letter string) rotated just 180 degrees from the letter string R6 of "New Year" in the second embodiment. Specifically, the letter string R7 is printed having the print length Lt2 similar to that of the second embodiment, longer than the print length Lt1 of the letter string R5 in an array direction (equivalent to a second array direction) where the letters "N", "e", "w", "Y", "e", "a", and "r" stand inverted and are juxtaposed side by side from right to left of the diagram in the tape length direction. At that time, the separation length from the center Ck of the letter string R7 in the tape length direction to the upstream end (the other end in the tape length direction) of the ribbon RB is set to Lc equal to that of the letter string R5, whereupon the margin length from the upstream end (the other end in the tape length direction; right end in the diagram) of the ribbon RB to the upstream end (right end in the diagram) of the letter string R7 results in Ls2 similar to that in the second embodiment, shorter than the margin length Ls 1 of the letter string R5.

Use Example

FIG. 21 shows an example of use of the thus printed and produced ribbon RB. In FIG. 21, the ribbon RB is affixed to the box B that is the target object at its leftward edge part in the diagram, the ribbon RB being generally curved with its print surfaces at both end portions bent (crossed in loop in this example) facing up, similar to the first and second embodiments. In use, the user loops the ribbon RB with its end portion vicinities being superimposed on each other and then adheres the ribbon RB at the loop position r1 to the box B that is the target object at the vicinity of a center thereof. At that time, the two tape end portion vicinity parts r2 and r3 (equivalent to both the tape end portion vicinity parts) protruding from the crossing part r4 of the ribbon RB to both end sides of the ribbon RB have a form protruding from the edge part of the box B to the exterior of the box B (i.e. into the air).

In this embodiment, the control procedure executed by the CPU included in the control portion 530 of the tape printer 1 may be the steps of the flow shown in FIG. 19 of the second embodiment, and therefore will not again be described in detail. It is to be noted in this embodiment that when the CPU generates print data for forming print on the ribbon RB at step S40, there is generated print data in which, as decorative tape process, the letter string R5 with upright-standing letters is arranged such that the corresponding center Ck is apart the separation length Lc from one end in the tape length direction while the letter string R7 with inverted letters (in other words, rotated 180 degrees from the letter string R5) is arranged such that the corresponding center Ck is apart the separation length Lc from the other end in the tape length direction.

A fourth embodiment of the present disclosure will be described with reference to FIGS. 22 to 24. This embodiment is an embodiment in which print of a mark for looping as described above is formed on the ribbon RB. Parts equivalent to those in the first to third embodiments and modification examples described above are designated by the same reference numerals, and explanations thereof will properly be omitted or simplified.

<External Appearance of Ribbon>

FIG. 22A is a plan view showing an exemplary external appearance of the ribbon of this embodiment. The ribbon RB of FIG. 22A has, similar to the ribbon RB shown in FIG. 5 of the first embodiment, the letter string R1 of upright-standing "ABCDE" at the left end portion in the diagram and the letter string R2 of inverted "ABCDE" at the right end portion in the diagram, with the full length Lr, print length Lt, margin length Ls, and separation length Lc similar thereto.

This embodiment is characterized by a mark M (black five-pointed asterisk) whose print is formed apart a predetermined length Lm from the downstream end (one end in the tape length direction; left end in the diagram). In the same manner, the mark M of the same shape and the same size as the above is print-formed at a position apart the length Lm from the upstream end (the other end in the tape length direction; right end in the diagram) of the ribbon RB.

In use of the ribbon RB, when looping the ribbon RB with its both end portion vicinities being superimposed on each other as described above, the user superimposes the two marks M on each other (i.e. using the marks M as guides) into a loop, as shown in FIG. 22B.

At the time of print formation, when the CPU for example generates the print data at step S40 of FIG. 9 on the basis of the result of acceptance and the result of decision at steps S10 to S30, there is generated print data in which the letter strings R1 and R2 are arranged at positions corresponding to the full length Lr, print length Lt, margin length Ls, and separation length Lc, with the marks M being arranged at positions apart the length Lm from the extremities of the ribbon RB. The positions (in other words, the length Lm) to form the marks M may be set by the CPU based on a value manually input by the user or may automatically be set at proper positions by the CPU based on the result of acceptance and the result of decision at steps S10 to S30 (see also examples in FIGS. 23A and 23B described later). This CPU's function for setting the position to form the mark M is equivalent to a mark setting portion as defined in claims.

An example of another mark is shown in FIGS. 23A and 23B. In this example, the letter strings R5 and R7 are arranged at positions corresponding to the full length Lr, print lengths Lt1 and Lt2, margin lengths Ls1 and Ls2, and separation length Lc described above using FIG. 20, with heart-shaped marks M being formed in place of the black five-pointed asterisks at positions apart the length Lm from the extremities of the ribbon RB. For example, in the position setting (automatic setting by the CPU) of the right-hand mark M in FIG. 23A, a separation length X between the letter string R7 and the mark M may be double the width W of the ribbon RB or more in order to reliably prevent the mark M from overlapping the letter string R7 that includes many letters and is relatively long.

In use, similar to FIG. 22B, when looping the ribbon RB with its both end portion vicinities being superimposed on each other, the user superimposes the two heart-shaped marks M on each other into a loop, as shown in FIG. 23B.

An example of yet another mark is shown in FIGS. 24A and 24B. In this example, the letter strings R1 and R2 are arranged at positions corresponding to the full length Lr, print length Lt, margin length Ls, and separation length Lc described above using FIG. 5, while four black circle marks U1 to U4 are formed to be used as guides for looping. In this example, the marks U1 and U3 are arranged near the letter string R1, facing each other in a somewhat slant direction with respect to the width direction of the ribbon RB. The marks U2 and U4 are arranged on the right side of the marks U1 and U3 in the tape length direction, facing each other in a somewhat slant direction with respect to the width direction of the ribbon RB in the same manner.

In use, as shown in FIG. 24B, when looping the ribbon RB with its both end portion vicinities being superimposed on each other, the user passes the tape end portion vicinity part r3 (equivalent to one end portion in the tape length direction in this embodiment) with the letter string R2 through between the four marks U1 to U4 (hereinafter, referred to appropriately as "mark U" if not distinguished from one another) and superimposes the part r3 on the tape end portion vicinity part r2 (equivalent to the other end portion in the tape length direction in this embodiment) with the letter string R1, into a loop. Thus, the marks U1 to U4 act as crossing-guides used when the tape end portion vicinity part r3 with the letter string R2 on one hand is superimposed on the tape end portion vicinity part r2 with the letter string R1 on the other.

The number of the marks U is not limited to four, and may be any number among one to three as long as they can act as guides when passing the tape end portion vicinity part r3 through therebetween as described above. Otherwise, five or more marks U may be disposed. The marks U may be disposed on the tape end portion vicinity part r3 with the letter string R2 that is overlying side, instead of disposing the marks U near the letter string R1. Otherwise, the marks U may be disposed on both the parts r2 and r3.

Other Modification Examples

Other than the above, the present disclosure has various modification examples which follow.

(A) Case of Disposing Plural Letter Strings on Each Side

Although the ribbon RB of the first embodiment shown in FIG. 5 has a single letter string R1 on the left end portion in the diagram and a single letter string R2 on the right end portion in the diagram, this is not limitative. For example, a plurality of letter strings R1 may be arrayed along the tape length direction or a plurality of letter strings R2 may be arrayed along the tape length direction. In such a case, the letter strings R1 and R2 may be arranged so as to fill all non-print intervals existing in the length direction between the letter string R1 and the letter string R2 in FIG. 5. In either case of the above, the interval between the adjacent letter strings R1 or between the adjacent letter strings R2 may variably set in accordance with the magnitude of the width of the ribbon RB (in other words, the width of the decorative print-receiving tape 301). Furthermore, when a plurality of letter strings R1 or a plurality of letter strings R2 are repeatedly printed to produce the ribbon RB, the interval between the adjacent letter strings R1 or between the adjacent letter strings R2 may be adjusted in accordance with the value of the full length Lr so as not to allow the cutting position for cutting the decorative print-receiving tape 301 to become incomplete. Moreover, the number of letter strings to be arranged, the letter size of each letter string, margin dimensions, etc. may variably be set in accordance with the magnitude of the width of the ribbon RB (in other words, the width of the decorative print-receiving tape 301).

(B) Case of Sharing Print Data Generation by Network

Although in the above embodiments and modification examples, the tape printer 1 is of a standalone form in which the device 1 performs, by itself, all of the edit and generation of print data and printing on the decorative print-receiving tape 301 and cutting thereof, the present disclosure is not limited to the above. For example, a so-called network configuration as shown in FIG. 25 may be employed that includes a tape printer 1A performing only printing on the decorative print-receiving tape 301 and cutting thereof and a general purpose PC 600 connecting via a proper network NW to the tape printer 1A, for sharing the edit and generation of print data.

In this case, the PC 600 is equivalent to an operation terminal as defined in claims; a CPU (esp. not shown) included in the PC 600 is equivalent to a computing device as defined in claims; and a print data edit/generation application is equivalent to a decorative tape production program as defined in claims, the application being stored in a memory (equivalent to a non-transitory computer-readable recording medium) such as a ROM of the PC 600, to be read and executed by the CPU. Execution of the print data edit/generation application by the CPU allows processes equivalent to those in the flow of FIG. 9 to be executed. At that time, a process equivalent to step S10 in FIG. 9 is equivalent to a letter string acceptance step as defined in claims; a process equivalent to step S20 is equivalent to a full-length setting step as defined in claims; processes equivalent to steps S30 and S40 are equivalent to a print data generation step as defined in claims; and a process of sending print data generated at the print data generation step to the tape printer 1A is equivalent to a print data sending step as defined in claims.

(C) Others

In the case that "vertical", "parallel", "plane", etc. appear in the above description, those terms are not used in a strict sense. Those "vertical", "parallel", "plane", etc. allow designing or manufacturing tolerances and errors and mean "substantially vertical", "substantially parallel", "substantial plane", etc., respectively.

In the case that there are expressions that the dimensions or sizes on appearance are "same", "equal", and "different" in the above description, those expressions are not used in a strict sense. Those "same", "equal", "different", etc. allow designing or manufacturing tolerances and errors and mean "substantially same", "substantially equal", "substantially different", etc., respectively. It is to be noted, however, that when there are described given criterion values or sectionalizing values such as threshold values or reference values, the terms "same", "equal", "different", etc. used therewith have their respective strict senses, dissimilar to the above.

In the above, arrows shown in FIG. 4 indicate an example of signal flow and are not intended to limit the direction of signal flow.

The flowcharts shown in FIGS. 9 and 19 are not intended to limit the present disclosure to the shown process steps, and the process steps may be added/deleted or changed in order without departing from the spirit and technical idea of the present disclosure.

Other than those already described, the techniques of the above embodiments and modification examples may be utilized in proper combination.

Although not exemplified one by one, the present disclosure is carried out with various changes applied thereto without departing from its spirit.

What is claimed is:

1. A tape printer comprising:

a feeder configured to feed a decorative print-receiving tape;

a printing head configured to form print on said decorative print-receiving tape fed by said feeder, to produce a decorative tape with print;

a letter string accepting portion configured to accept input of one or two letter strings for forming print on said decorative print-receiving tape;

a full-length setting portion configured to set a full length of said decorative tape with print;

a print data generating portion configured to generate print data in which two processed letter strings generated by applying a predetermined decorative tape process to said one or two letter strings accepted by said letter string accepting portion are arranged at one end portion and another end portion of said decorative print-receiving tape in a tape length direction, the decorative print-receiving tape having said full length set by said full-length setting portion; and a coordination control portion configured to control said feeder and said printing head in coordination with each other using said print data generated by said print data generating portion, to produce said decorative tape with print having said full length.

2. The tape printer according to claim 1, wherein said letter string accepting portion is configured to accept input of a first letter string and a second letter string that differ from each other, and said print data generating portion is configured to generate said print data in which, as said decorative tape process, said first letter string is arranged at the one end portion in said tape length direction on said decorative print-receiving tape and said second letter string is arranged at the other end portion in said tape length direction on said decorative print-receiving tape as said processed letter strings, with a length from one end in said tape length direction to a center of said first letter string in said tape length direction being equal to a length from the other end in said tape length direction to a center of said second letter string in said tape length direction.

3. The tape printer according to claim 1, wherein said print data generating portion is configured to generate said print data in which, as said decorative tape process, one said letter string is arranged as said processed letter string in a first array direction at the one end portion of said decorative print-receiving tape in said tape length direction as well as one said letter string is arranged as said processed letter string in a second array direction rotated 180 degrees from said first array direction at the other end portion of said decorative print-receiving tape in said tape length direction, wherein the decorative print-receive tape has said full length.

4. The tape printer according to claim 3, wherein said letter string accepting portion is configured to accept input of one third letter string, and said print data generating portion is configured to generate said print data in which, as said decorative tape process, said third letter string is arranged as said processed letter string in said first array direction at the one end portion in said tape length direction, with said third letter string being arranged as said processed letter string in said second array direction at the other end portion in said tape length direction.

5. The tape printer according to claim 4, wherein said print data generating portion is configured to generate said print data in which, as said decorative tape process, a length from one end in said tape length direction to a center of a letter string lying on a side of the one end becomes equal to a length from the other end in said tape length direction to a center of a letter string lying on a side of the other end.

6. The tape printer according to claim 3, wherein said letter string accepting portion is configured to accept input of a fourth letter string and a fifth letter string that differ from each other, and said print data generating portion is configured to generate said print data in which, as said decorative tape process, said fourth letter string is arranged as said processed letter string in said first array direction at the one end portion in said tape length direction, with said fifth letter string being arranged as said processed letter string in said second array direction at the other end portion in said tape length direction.

7. The tape printer according to claim 1, further comprising:

a mark setting portion configured to set a mark formation position for superimposition performed when said decorative tape with print is looped in accordance with a result of acceptance by said letter string accepting portion and a result of setting by said full-length setting portion, wherein said print data generating portion is configured to generate said print data in which at least one mark is arranged at said mark formation position set by said mark setting portion.

8. The tape printer according to claim 7, wherein said at least one mark includes two marks with a same shape and a same size, arranged corresponding respectively to said two processed letter strings.

9. The tape printer according to claim 7, wherein said at least one mark includes a plurality of marks functioning as crossing-guides used when the one end portion in said tape length direction with one of said two processed letter strings formed thereon is superimposed on the other end portion in said tape length direction with the other of said two processed letter strings formed thereon.

10. A non-transitory computer-readable recording medium, storing a decorative tape production program for executing steps on a computing device that is disposed on an operation terminal for operating a tape printer, the tape printer including a feeder to feed a decorative print-receiving tape and a printing head to form print on said decorative print-receiving tape fed by said feeder, to produce a decorative tape with print, said steps comprising:

a letter string accepting step for accepting input of one or two letter strings for forming print on said decorative print-receiving tape;

a full-length setting step for setting a full length of said decorative tape with print;

a print data generating step for generating print data in which two processed letter strings generated by applying a predetermined decorative tape process to said one or two letter strings accepted in said letter string accepting step are arranged at one end portion and another end portion of said decorative print-receiving tape in a tape length direction, the decorative print-receiving tape having said full length set in said full-length setting step; and a print data sending step for sending said print data generated in said print data generating step to said tape printer, to produce said decorative tape with print having said full length.

* * * * *